US009508505B2

(12) United States Patent
Hsu

(10) Patent No.: US 9,508,505 B2
(45) Date of Patent: Nov. 29, 2016

(54) KEYSWITCH STRUCTURE

(71) Applicant: DARFON ELECTRONICS CORP., Taoyuan (TW)

(72) Inventor: Chien-Shih Hsu, Taoyuan (TW)

(73) Assignee: DARFON ELECTRONICS CORP., Taoyuan (TW)

( * ) Notice: Subject to any disclaimer, the term of this patent is extended or adjusted under 35 U.S.C. 154(b) by 0 days.

(21) Appl. No.: 14/709,489

(22) Filed: May 12, 2015

(65) Prior Publication Data

US 2015/0332875 A1 Nov. 19, 2015

(30) Foreign Application Priority Data

May 15, 2014 (TW) ..... 103117198 A
Apr. 2, 2015 (TW) ..... 104110958 A

(51) Int. Cl.
*H01H 13/7065* (2006.01)
*H01H 3/12* (2006.01)

(52) U.S. Cl.
CPC ..... *H01H 13/7065* (2013.01); *H01H 3/125* (2013.01); *H01H 2221/04* (2013.01); *H01H 2231/002* (2013.01)

(58) Field of Classification Search
CPC ..... H01H 13/14; H01H 2221/058; H01H 2215/00; H01H 2227/032; H01H 2231/002; H01H 13/7065; H01H 3/125; H01H 2221/04; H01H 3/122; H01H 3/503; H01H 3/506; H01H 13/00; H01H 13/02; H01H 13/20; H01H 13/52; H01H 9/00
USPC ..... 200/344, 341, 404; 400/495
See application file for complete search history.

(56) References Cited

U.S. PATENT DOCUMENTS 6,677,843 B1 * 1/2004 Monroe ..... H01H 13/705 200/512
8,970,331 B2 * 3/2015 Chang ..... H01H 13/702 200/341
9,064,651 B2 * 6/2015 Hsu ..... H01H 13/7065
2016/0055989 A1 * 2/2016 Hsu ..... H01H 13/14 200/344

FOREIGN PATENT DOCUMENTS

CN 202601436 U 12/2012
TW 201340153 10/2013

* cited by examiner

*Primary Examiner* — Edwin A. Leon
(74) *Attorney, Agent, or Firm* — Winston Hsu; Scott Margo

(57) ABSTRACT

A keyswitch structure includes a bottom plate, a keycap, a first support, a second support, and a magnetic member. The bottom plate has a magnetic portion. The keycap is disposed above the bottom plate. The first support and the second support are disposed between the bottom plate and the keycap. The keycap is capable of moving up and down relative to the bottom plate through the first support and the second support. The magnetic member is disposed between the bottom plate and the keycap corresponding to the magnetic portion. The magnetic member and the magnetic portion induce an attractive force therebetween. The attractive force makes the magnetic member contact and apply force to the first support and the second support so that the first support and the second support tend to move the keycap away from the bottom plate.

29 Claims, 20 Drawing Sheets

KEYSWITCH STRUCTURE

BACKGROUND OF THE INVENTION

1. Field of the Invention

The invention relates to a keyswitch structure, and especially relates to a keyswitch structure using magnetic attractive force for restoration.

2. Description of the Prior Art

Conventional keyswitch structures usually have a scissors supporting member by which a keycap can move up and down. The keyswitch structure also has a resilient member (e.g. silicone dome) that is disposed under the keycap and produces a restoration force to move the keycap to its original position (i.e. where the keycap is not press). The supporting member and the resilient member are usually disposed compactly for a reduction in the disposition space required for the keyswitch structure. However, the scissors supporting member consists of cross-connected supports, in which the silicone dome is disposed, so that the supporting member has a certain degree of structural complexity. Furthermore, the silicone dome needs a certain volume for providing a user a sufficient pressing feedback feeling (i.e. a reaction force the user feels when pressing the keycap), which leads to a limitation on the disposition space required for the keyswitch structure. Therefore, it is difficult to apply the keyswitch structure to thin keyboards unless the movement stability of the keycap can be reduced or ignored.

SUMMARY OF THE INVENTION

An objective of the invention is to provide a keyswitch structure that uses a magnetic member and a bottom plate to induce an attractive force therebetween to drive two supports that support a keycap, so a stable movement of the keycap and a sufficient feedback feeling can be met. Therefore, the keyswitch structure is suitable for thin keyboards (such as but not limited to notebook keyboards).

A keyswitch structure according to invention includes a bottom plate, a keycap, a first support, a second support, a magnetic member. The bottom plate has a magnetic portion. The keycap is disposed above the bottom plate. The first support is disposed between the bottom plate and the keycap. The second support is disposed between the bottom plate and the keycap. The keycap is capable of moving up and down relative to the bottom plate through the first support and the second support. The magnetic member is disposed between the bottom plate and the keycap corresponding to the magnetic portion. An attractive force is induced between the magnetic member and the magnetic portion. The magnetic member and the magnetic portion induce an attractive force therebetween. The attractive force makes the magnetic member contact and apply force to the first support and the second support so that the first support and the second support are driven to move the keycap away from the bottom plate. In practice, the first support can be a plastic part (for example a plastic injection part). The magnetic member can be directly fixed on the first support (for example by insert molding), so that the first support and the magnetic member are joined to be a single member and act together, which improves the stability of the force transfer between the magnetic member and the first support.

Compared with the prior art, the mechanism (i.e. the magnetic member and the magnetic portion), which the keyswitch structure according to the invention uses to produce a restoration force, can operate normally with not much space, so that a constraint on the structural and movement of the first support and the second support can be reduced. Furthermore, a required magnitude of the attractive force can be met by choosing proper materials for the magnetic member and the magnetic portion, without increasing the volume thereof. Thereby, the movement stability and structural strength of the first support and the second support can be maintained in a certain degree or better. Therefore, the keyswitch structure according to the invention can overcome the problem in the prior art that when the conventional keyswitch structure is applied to a thin keyboard, its keycap can hardly act stably and the feedback feeling produced thereby is insufficient.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
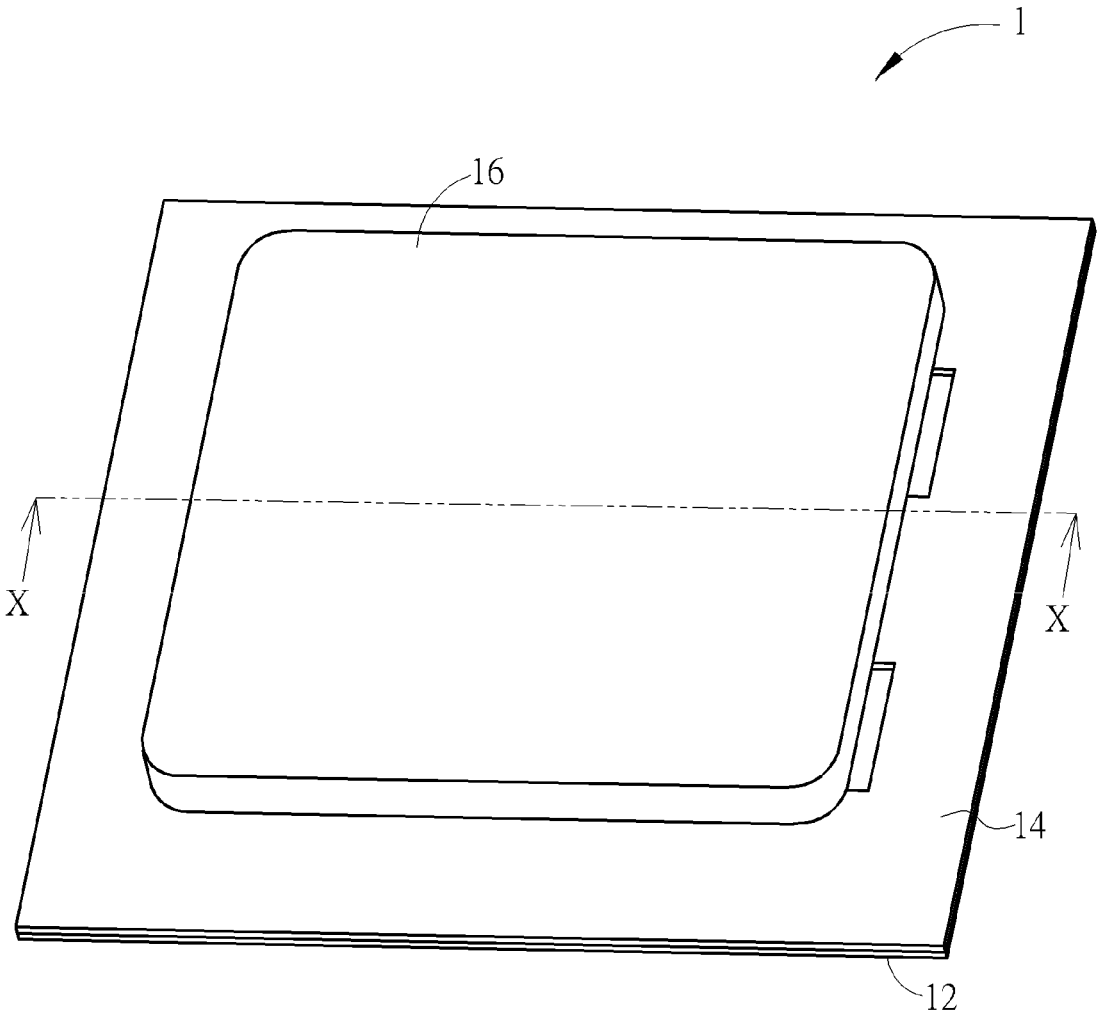
FIG. 1 is a schematic diagram illustrating a keyswitch structure of an embodiment according to the invention.
Figure 2:
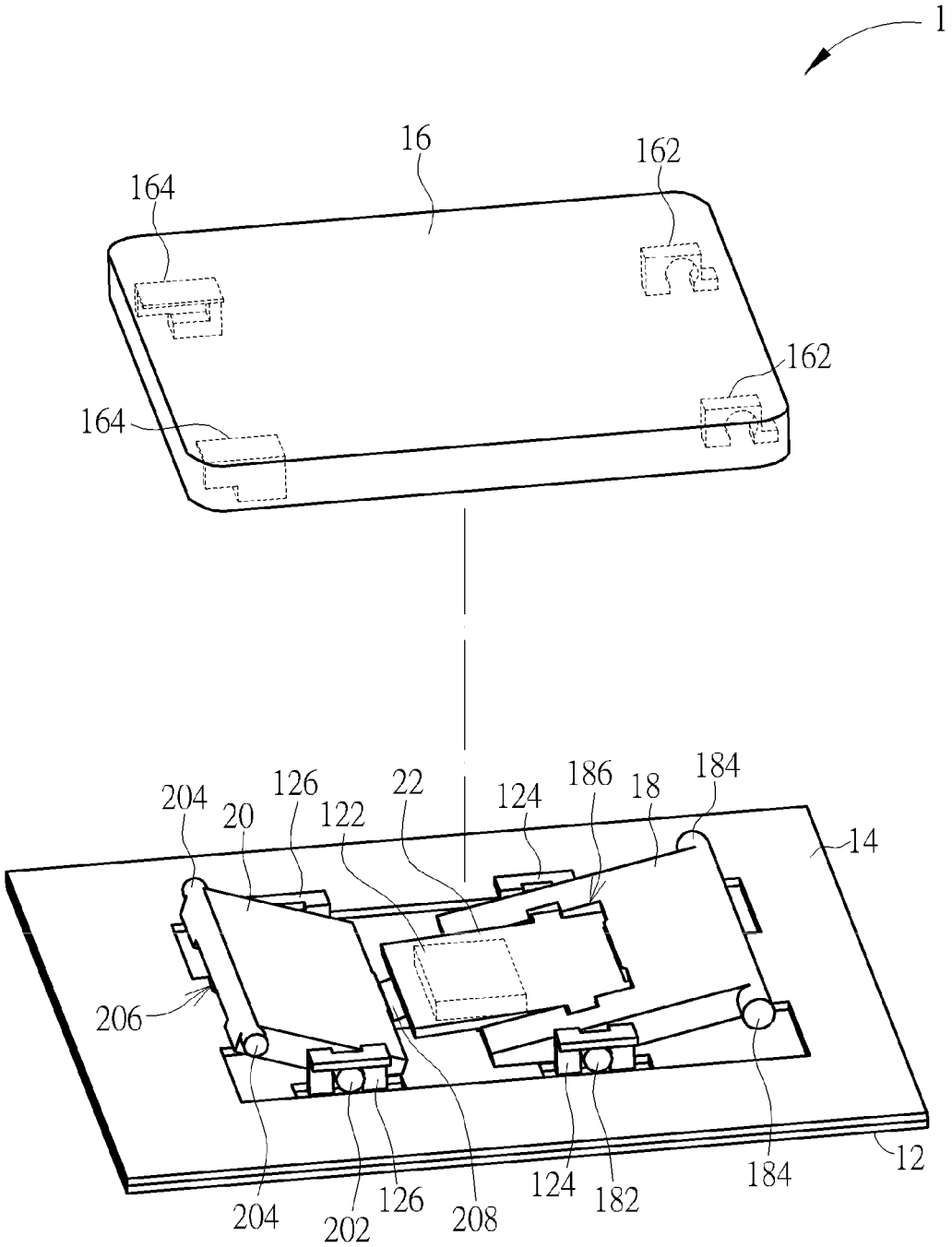
FIG. 2 is a partially-exploded view of the keyswitch structure in FIG. 1.
Figure 3:
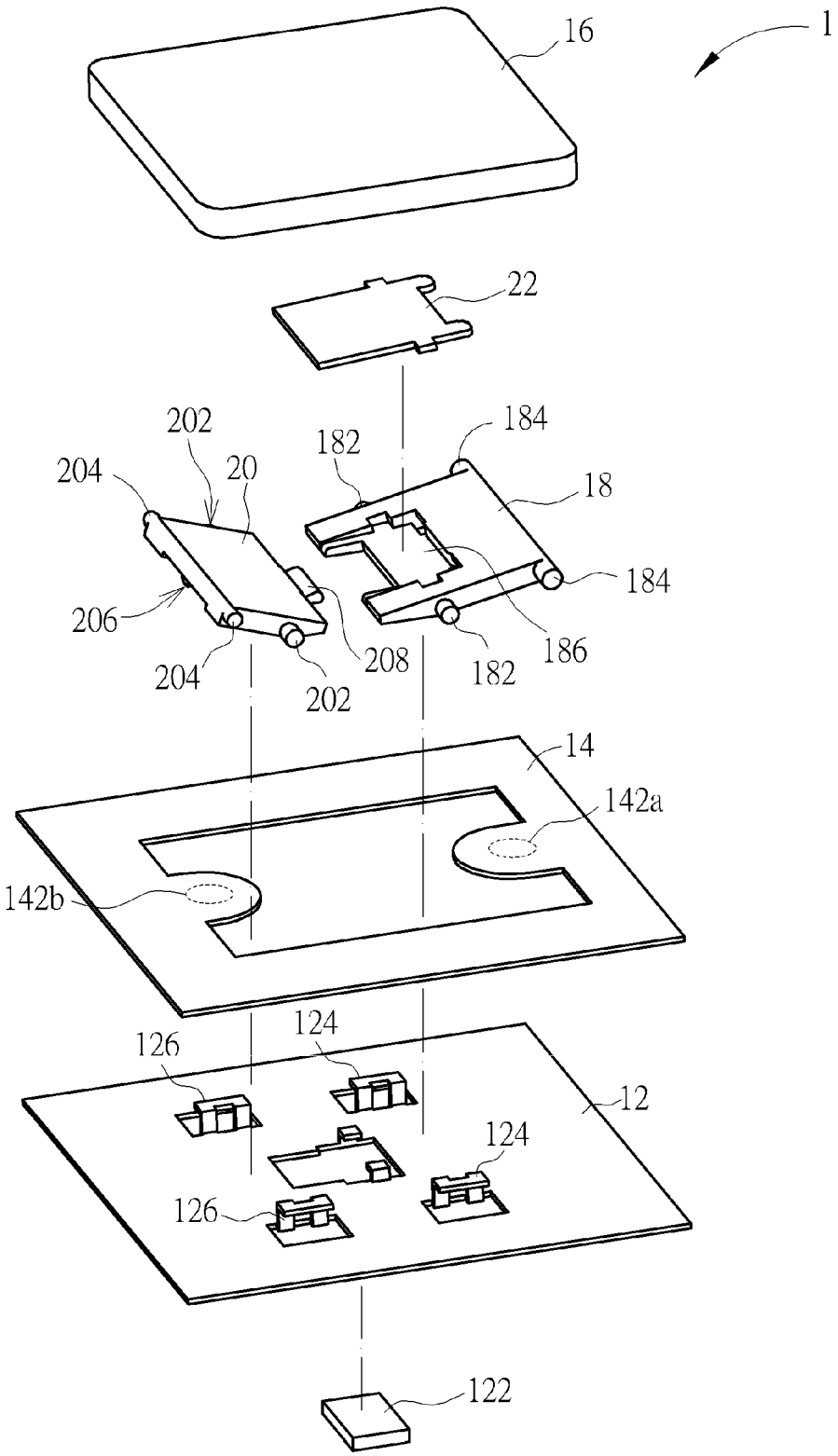
FIG. 3 is an exploded view of the keyswitch structure in FIG. 1.
Figure 4:
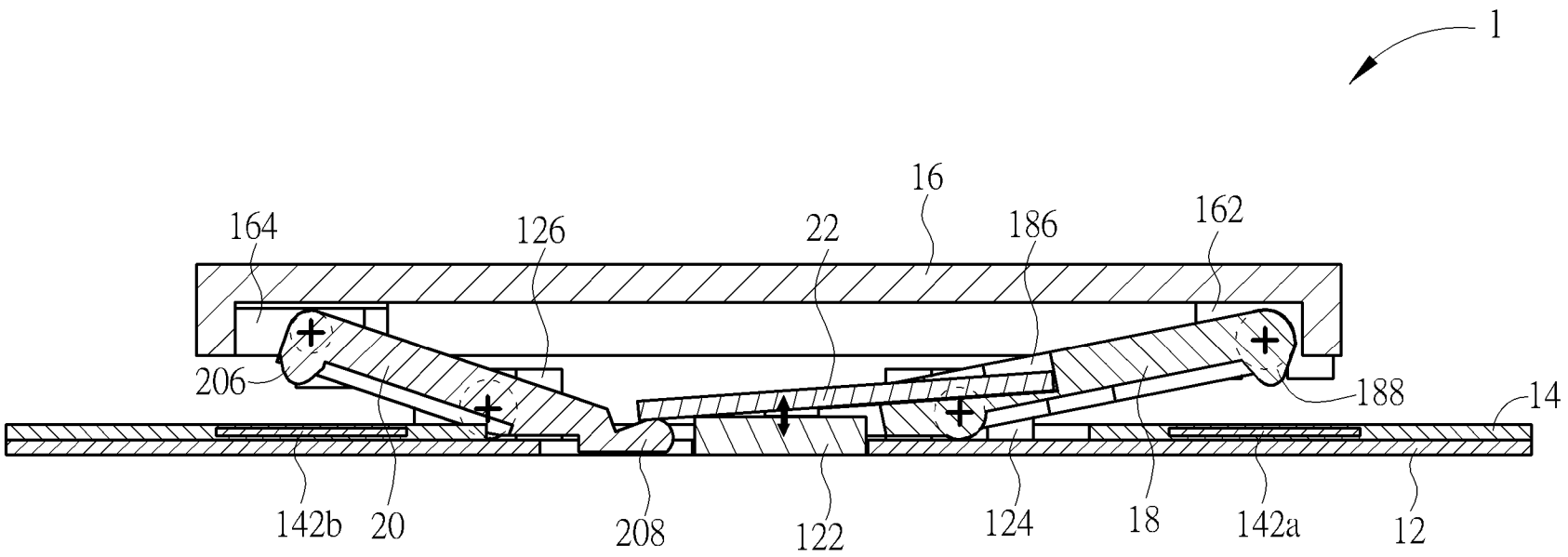
FIG. 4 is a sectional view of the keyswitch structure in FIG. 1 along the line X-X.

Please refer to FIGS. 1 to 4. FIG. 1 is a schematic diagram illustrating a keyswitch structure 1 of an embodiment according to the invention. FIG. 2 is a partially-exploded view of the keyswitch structure 1. FIG. 3 is an exploded view of the keyswitch structure 1. FIG. 4 is a sectional view of the keyswitch structure 1 along the line X-X in FIG. 1. The keyswitch structure 1 includes a bottom plate 12, a membrane circuit board 14, a keycap 16, a first support 18, a second support 20, and a magnetic member 22. The bottom plate 12 has a magnetic portion 122 (shown by hidden lines in FIG. 2) and a plurality of connection portions 124 and 126. In the embodiment, the bottom plate 12 mainly is a combination of a metal pressing part with a magnet (that acts as the magnetic portion 122); however, the invention is not limited thereto. The membrane circuit board 14 is stacked on the bottom plate 12 and has two switches 142*a* and 142*b* (represented by dashed circles in FIG. 3). Therein, the connection portions 124 and 126 pass through holes of the membrane circuit board 14 and protrude out of the membrane circuit board 14. The keycap 16 is disposed above the bottom plate 12 and the membrane circuit board 14 and has a plurality of connection portions 162 and 164 (shown by hidden lines in FIG. 2). The first support 18 and the second support 20 are oppositely disposed between the bottom plate 12 and the keycap 16. The first support 18 is a plastic part (for example a plastic injection part) and rotatably abuts the bottom plate 12 through a pivot structure 182 of the first support 18 and the connection portions 124. A pivot structure 184 of the first support 18 movably (e.g. rotatably in the embodiment) abuts the connection portions 162. The second support 20 rotatably abuts the bottom plate 12 through a pivot structure 202 of the second support 20 and the connection portions 126. A pivot structure 204 of the second support 20 movably (e.g. slidably in the embodiment) abuts the connection portions 164. Thereby, the keycap 16 can move up and down relative to the bottom plate 12 through the first support 18 and the second support 20. Therein, the pivot structures 182 and 202 are located between the pivot structures 184 and 204. The pivot structures 182, 184, 202 and 204 are respectively realized by two protruding bosses; however, the invention is not limited thereto. In addition, the connection portions 162 can be provided in the shape as the connection portions 164, so that the pivot structure 184 can slidably abut the connection portions 162. In FIG. 4, rotation axes about which the pivot structures 182, 184, 202 and 204 rotate relative to the bottom plate 12 and the keycap 16 are indicated by cross marks in the figure; projections of the pivot structures 182, 184, 202 and 204 on the plane shown by FIG. 4 are indicated by dashed circles.

The magnetic member 22 is disposed between the bottom plate 12 and the keycap 16 corresponding to the magnetic portion 122 and is fixed on the first support 18, so the magnetic member 22 also is rotatable relative to the bottom plate 12 and the magnetic member 22 and the first support 18 are rotatable relative to the bottom plate 12 about the same rotation axis. In the embodiment, the magnetic member 22 such as a paramagnetic metal part is mounted by an embedding way in a recess 186 formed on the first support 18. The embedding way can be adhering, tight fitting, inserting into a slot, or insert injecting. The magnetic member 22 and the magnetic portion 122 can induce an attractive force (indicated by a bold line segment with two arrows in FIG. 4) therebetween, so that the magnetic member 22 and the magnetic portion 122 tend to approach each other. Therein, the magnetic member 22 is disposed facing the magnetic portion 122, but the invention is not limited thereto. In principle, a disposition of the magnetic member 22 and the magnetic portion 122 can be accepted on condition that the attractive force meets a product requirement, for example of being capable of driving the first support 18 and the second support 20 to move, providing a required feedback feeling (i.e. a reaction force felt by a user when pressing the keycap 16), and so on. The attractive force makes the magnetic member 22 apply force to the first support 18 and contact and apply force to the second support 20. Because the magnetic member 22 and the first support 18 are joined together, where the attractive force is applied can be regarded as the position where the attractive force is applied to the first support 18. Therefore, the positions where the magnetic member 22 is applied to the first support 18 and the second support 20 are located between the pivot structures 182 and 184 and the pivot structures 202 and 204. According to the lever rule, the attractive force can drive the first support 18 and the second support 20 to rotate to move the keycap 16 away from the bottom plate 12. Therein, the position where the attractive force is applied to the first support 18 and the pivot structure 184 are located at two opposite sides of the pivot structure 182; the position where the attractive force is applied to the second support 20 and the pivot structure 204 are located at two opposite sides of the pivot structure 202. Therefore, the attractive force drives the first support 18 through the magnetic member 22, so that the first support 18 rotates counterclockwise, and also drives the second support 20 to rotate clockwise. In addition, when the keycap 16 is not pressed, the attractive force can keep the magnetic member 22 contacting a protruding end 208 of the second support 20. The protruding end 208 is located between the pivot structure 202 and the magnetic member 22. When rotating counterclockwise, the second support 20 can lift the magnetic member 22 by a smaller force.

Figure 5:
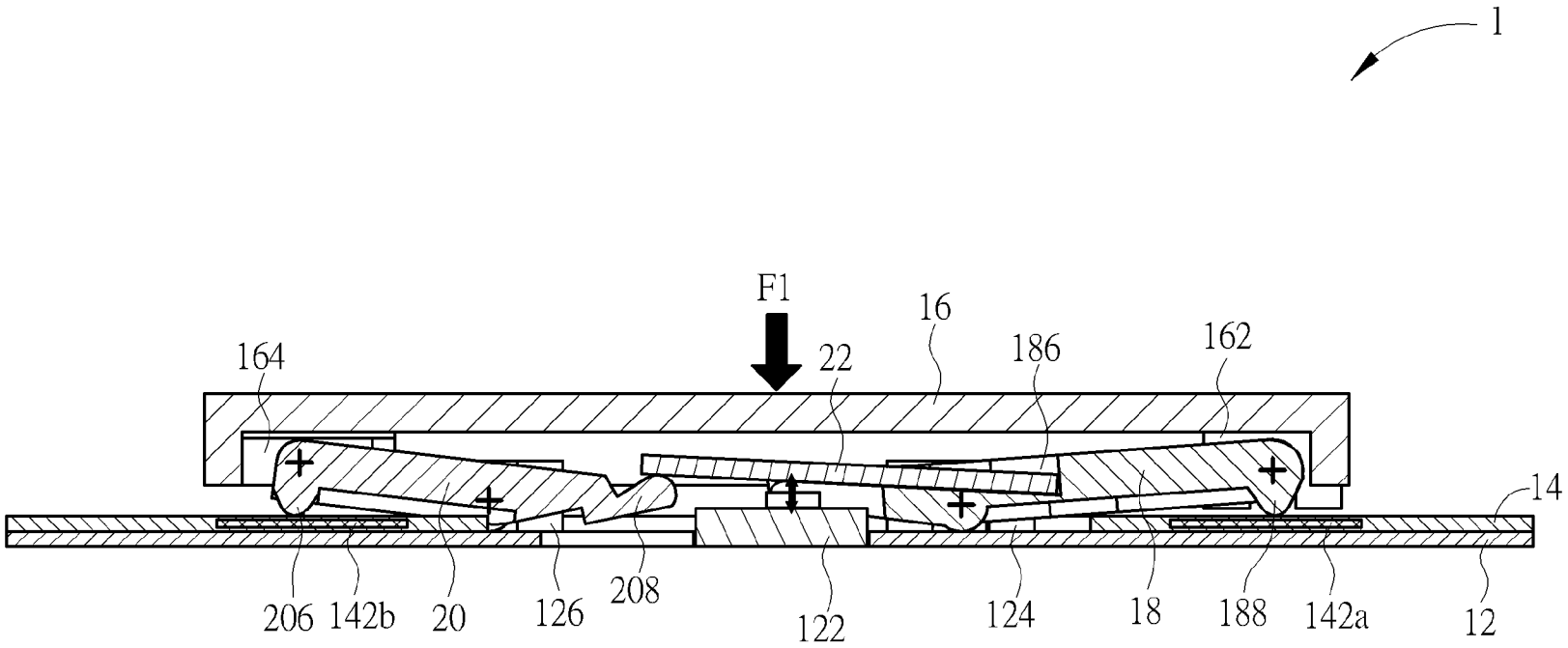
FIG. 5 is a sectional view of the keyswitch structure in FIG. 1 when a keycap thereof is pressed.

Please also refer to FIG. 5. FIG. 5 is a sectional view of the keyswitch structure 1 after pressed. When the keycap 16 is pressed horizontally (as shown in FIG. 5, in which an external force F1 is applied substantially to the middle portion of the keycap 16), the first support 18 and the second support 20 rotate clockwise and counterclockwise respectively under the constraint by the keycap 16 and the bottom plate 12. Because the magnetic member 22 is fixed on the first support 18, the magnetic member 22 will rotate in the same direction as the first support 18 rotates. That is, the magnetic member 22 moves away from the magnetic portion 122 as the first support 18 rotates clockwise. Furthermore, when rotating counterclockwise, the second support 20 contacts and moves the magnetic member 22 away from the magnetic portion 122 through the protruding end 208, which is conducive to clockwise rotation of the first support 18. In the embodiment, the first support 18 includes a protrusion 188 corresponding to the switch 142*a*. The second support 20 includes a protrusion 206 corresponding to the switch 142*b*. When the keycap 16 is pressed horizontally, the protrusions 188 and 206 can touch the membrane circuit board 14 for triggering the switches 142*a* and 142*b*. At the meanwhile, the attractive force (indicated by a bold line segment with two arrows in FIG. 5) induced between the magnetic member 22 and the magnetic portion 122 decreases but still can drive the magnetic member 22 to approach the magnetic portion 122. When the external force F1 is removed, the attractive force drives the magnetic member 22 to move toward the magnetic portion 122. At the meanwhile, the magnetic member 22 applies force to the first support 18 and contacts and applies force to the second support 20 for driving the first support 18 and the second support 20 to rotate counterclockwise and clockwise respectively, so that the keycap 16 moves away from the bottom plate 12 to its original position (as shown by FIG. 4).

Figure 6:
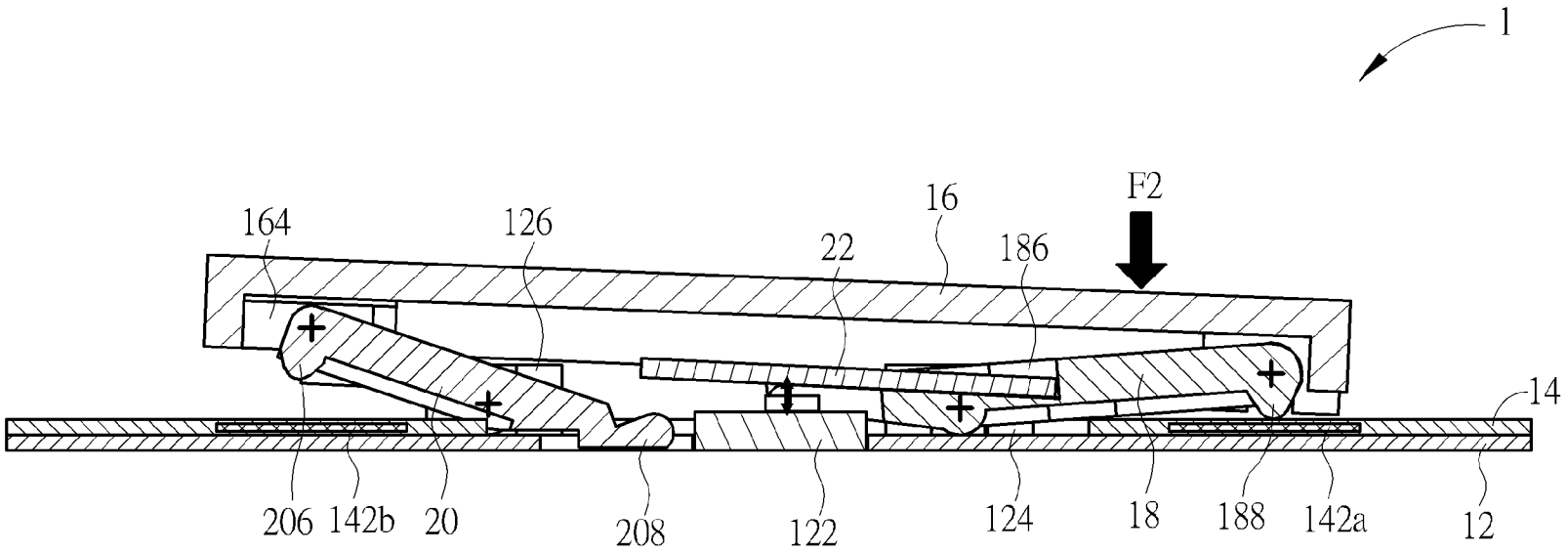
FIG. 6 is a sectional view of the keyswitch structure in FIG. 1 when the keycap is pressed obliquely at the right side.

When the keycap 16 is pressed obliquely (as shown in FIG. 6, in which the keycap 16 is pressed right side down with an external force F2 applied substantially at the right side of the keycap 16), the magnetic member 22 rotates clockwise together with the first support 18 and moves away from the magnetic portion 122. At the meanwhile, though the second support 20 seems not rotated, the first support 18 itself has the protrusion 188 so that the protrusion 188 still can effectively touch the membrane circuit board 14 for triggering the switch 142*a*. That is, the keyswitch structure 1 is pressed effectively, so the oblique pressing is effective. Similarly, when the external force F2 is removed, the attractive force drives the magnetic member 22 to move toward the magnetic portion 122. At the meanwhile, the magnetic member 22 applies force to the first support for driving the first support 18 to rotate counterclockwise, so that the keycap 16 moves away from the bottom plate 12 to its original position (as shown by FIG. 4).

Figure 7:
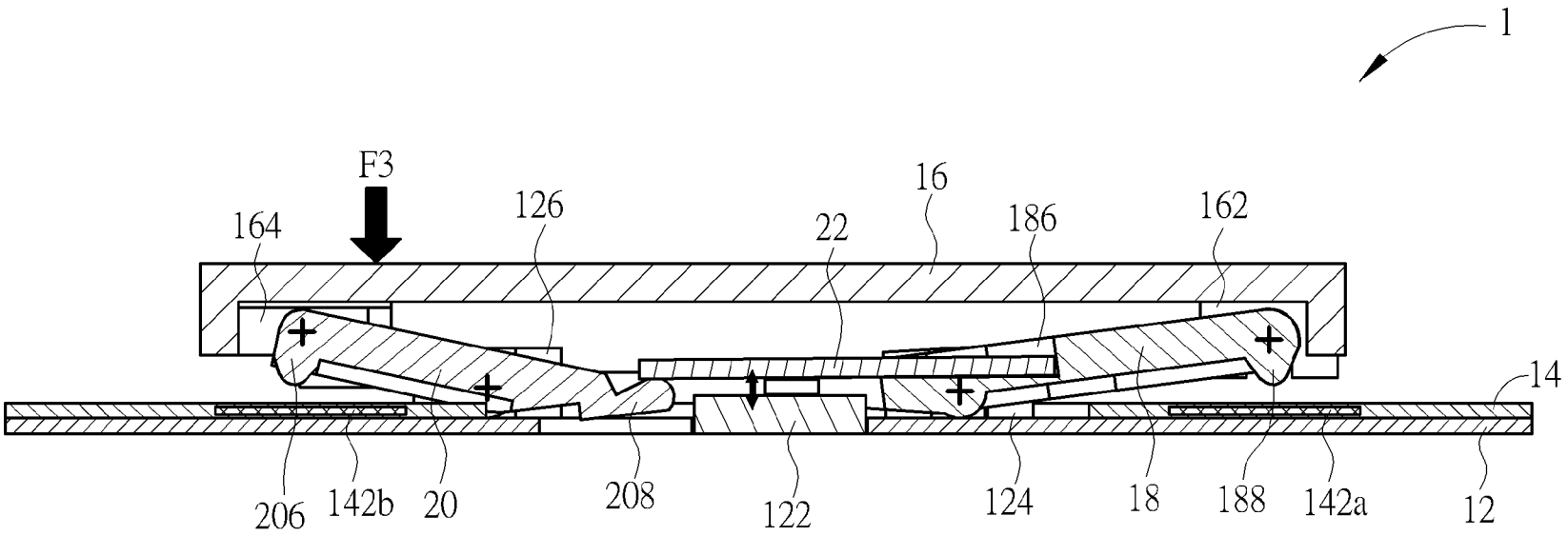
FIG. 7 is a sectional view of the keyswitch structure in FIG. 1 when the keycap is pressed at the left side.

When the keycap 16 is pressed left by an external force F3 to move toward the bottom plate 12 (as shown in FIG. 7, in which the external force F3 is applied substantially to the left side of the keycap 16), the second support 20 rotates counterclockwise under constraint by the bottom plate 12 and the keycap 16. During the counterclock rotation of the second support 20, the magnetic member 22 is driven by the attractive force and keeps contacting the second support 20, so that the second support 20 drives the first support 18 through the magnetic member 22 to rotate clockwise, the keycap 16 moves downward substantially horizontally, and the protrusions 188 and 206 can touch the membrane circuit board 14 for triggering the switches 142*a* and 142*b*. Similarly, when the external force F3 is removed, the attractive force drives the magnetic member 22 to move toward the magnetic portion 122. At the meanwhile, the magnetic member 22 applies force to the first support 18 and contacts and applies force to the second support 20 for driving the first support 18 and the second support 20 to rotate counterclockwise and clockwise respectively, so that the keycap 16 moves away from the bottom plate 12 to its original position (as shown by FIG. 4). Therefore, in the above situation, the movement of the keycap 16 is similar to that of the keycap 16 in FIG. 5; i.e., the keycap 16 substantially horizontally moves up and down relative to the bottom plate 12 for both situations.

As discussed above, the attractive force induced between the magnetic member 22 and the magnetic portion 122 applies force to the first support 18 and the second support 20 directly by the magnetic member 22 and provides rotation moments to the first support 18 and the second support 20, so that the effect of the attractive force on the first support 18 and the second support 20 is stable and reliable. In the embodiment, the first support 18 and the second support 20 are separate; that is, they do not connect with or contact each other directly. However, the first support 18 is still affected by movement of the second support 20 through the magnetic member 22, such as the movement shown by FIG. 7. But the invention is not limited thereto. For example, in practice, the first support 18 and the second support 20 can also structurally contact or connect with each other for enhancing the movement linkage of the first support 18 and the second support 20.

Furthermore, in the embodiment, the first support 18 and the second support 20 are disposed structurally symmetrically, so that when the keycap 16 moves up and down relative to the bottom plate 12, the first support 18 and the second support 20 rotates relative to the bottom plate 12 in opposite directions, i.e. counterclockwise and clockwise, or clockwise and counterclockwise; however, the invention is not limited thereto. For example, in a practical case, in which the first support 18 and the second support 20 are separate, the first support 18 and the second support 20 still can be designed to rotate in the same direction when the keycap 16 moves up and down relative to the bottom plate 12. In this case, the disposition of other components may need to be modified and may be a little different to the above embodiment, but the disposition still can be achieved by one of ordinary skill in the art according to the specification and drawings and will not be repeated in addition. Furthermore, in the embodiment, the second support 20 includes a first portion, a second portion, and a third portion. The first portion (i.e. the pivot structure 204) rotatably abuts the keycap 16. The second portion (i.e. the pivot structure 202) rotatably abuts the bottom plate 12. The third portion (i.e. the protruding end 208) keeps contacting the magnetic member 22. The second portion is located between the first portion and the third portion. That is, the applied forces by the magnetic member 22 and the keycap 16 to the second support 20 are located at two opposite sides of a fulcrum (i.e. the pivot structure 202), so that the second support 20 acts as a seesaw. In the embodiment, the first support 18 and the second support 20 can be made of plastic materials, for example formed by an injection method which facilitates the control of structural size and the required size precision, so that the pivot structures 184 and 204 stably abut the connection portions 164 and 162 of the keycap 16 and the keycap 16 is therefore provided with a better extraction force. Furthermore, the first support 18 and the second support 20 can be made of light penetrable materials and coordinate with a back light module to form an illuminated keyboard with a better illumination effect.

In addition, in the embodiment, the attractive force induced by the magnetic member 22 and the magnetic portion 122 can be achieved by oppositely disposing a paramagnetic metal part (i.e. the magnetic member 22) and a magnet (i.e. the magnetic portion 122); however, the invention is not limited thereto. For example, a magnet is used as the magnetic member 22; a paramagnetic metal part is used as the magnetic portion 122. An attractive force is induced therebetween. In this case, if the bottom plate 12 is made of a paramagnetic metal part, a portion of the bottom plate 12 corresponding to the magnetic member 22 can be regarded as the magnetic portion 122, which is conducive to reduction in the complexity of the bottom plate 12. Furthermore, for example, the magnetic portion 122 and the magnetic member 22 are realized by magnets disposed in reverse poles; an attractive force also can be induced therebetween.

Figure 8:
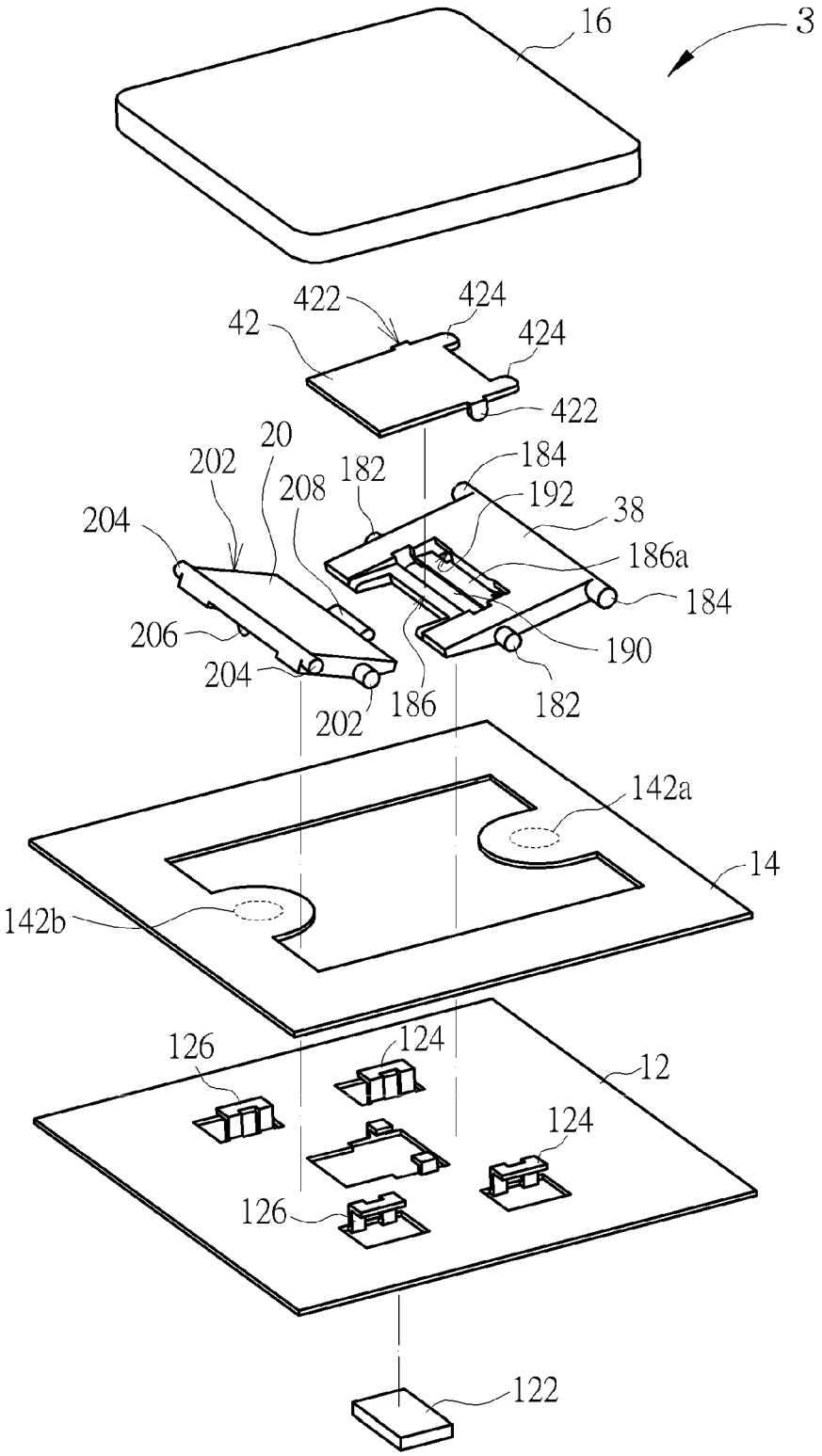
FIG. 8 is an exploded view of a keyswitch structure of another embodiment according to the invention.
Figure 9:
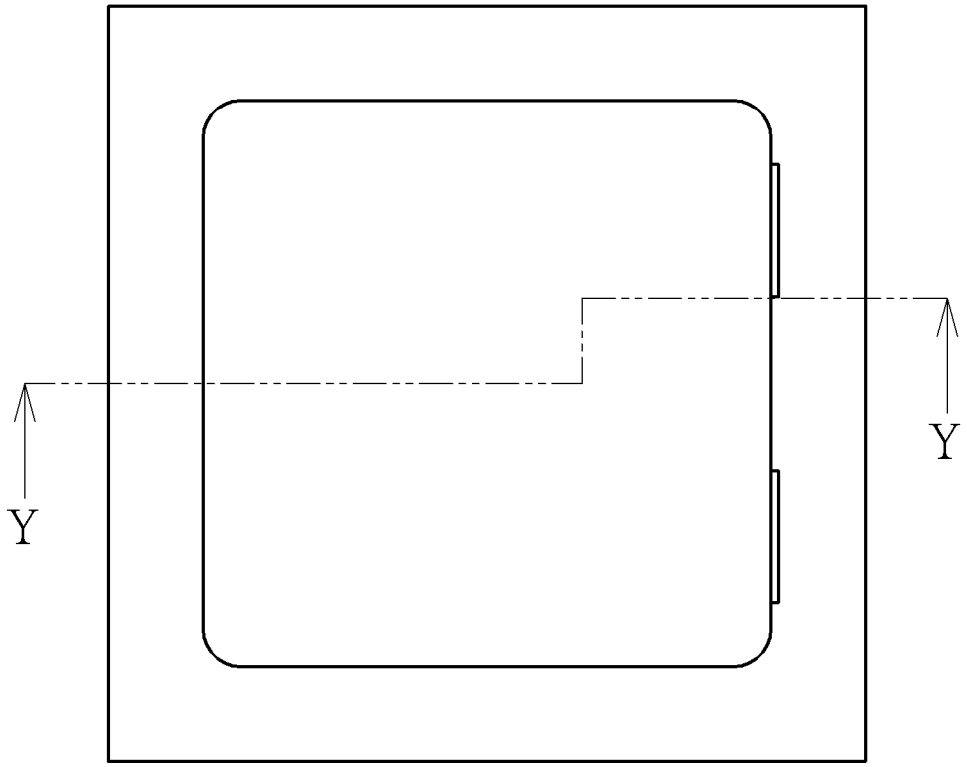
FIG. 9 is a top view of the keyswitch structure in FIG. 8.
Figure 10:
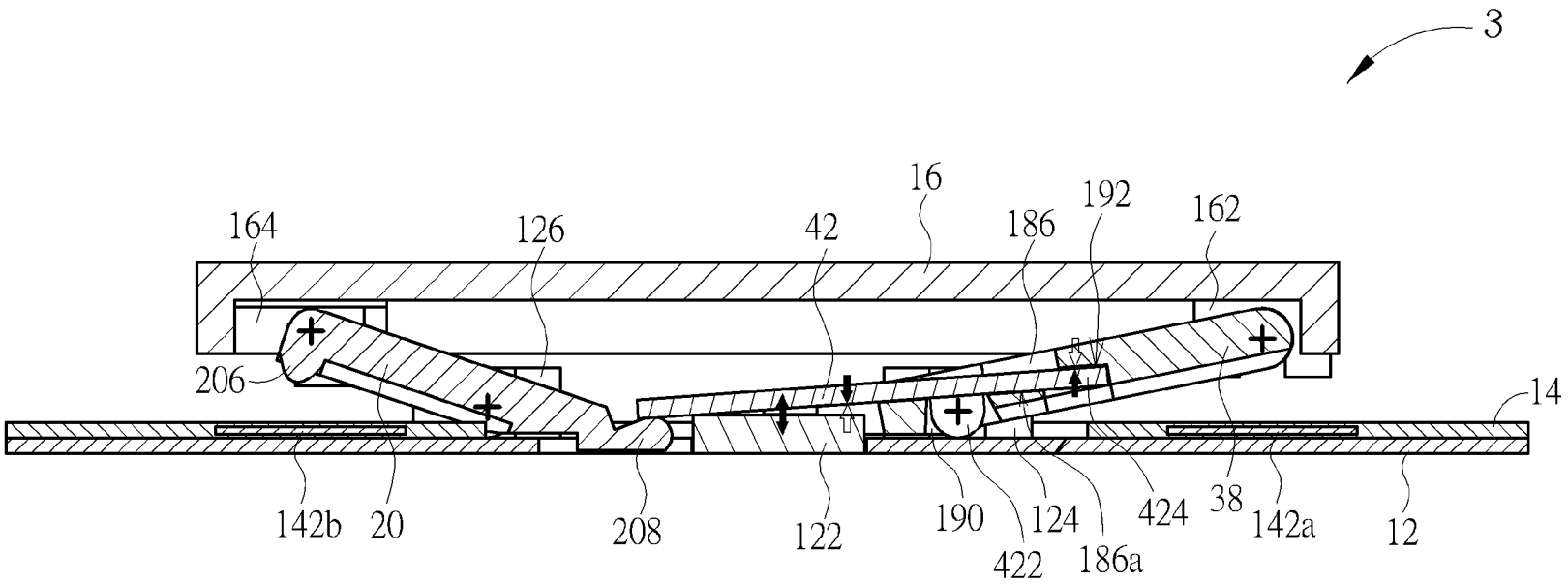
FIG. 10 is a sectional view of the keyswitch structure in FIG. 8 along the line Y-Y.

In the above embodiment, the first support 18 is a plastic part, to which the magnetic member 22 can be joined easily by an insertion method, but the invention is not limited thereto. For example, even though the first support is a metal part (such as a pressing part), the magnetic member 22 still can be fixed in the recess 186 of the first support 18 by adhering, tight fitting, or inserting into a slot. Furthermore, the keyswitch structure according to the invention is not limited to the case that the magnetic member 22 is fixedly joined to the first support 18. Please refer to FIGS. 8 to 10. FIG. 8 is an exploded view of a keyswitch structure 3 of another embodiment according to the invention. FIG. 9 is a top view of the keyswitch structure 3. FIG. 10 is a sectional view of the keyswitch structure 3 along the line Y-Y. The keyswitch structure 3 is structurally similar to the keyswitch structure 1, so the keyswitch structure 3 uses the same notations of the keyswitch structure 1 for components with the same names. The following description will focus on differences between the keyswitch structure 3 and the keyswitch structure 1. For the other descriptions of the keyswitch structure 3, please refer to the relevant descriptions of the keyswitch structure 1, which will not be repeated in addition.

In the embodiment, a magnetic member 42 of the keyswitch structure 3 includes two abutting portions 422 and two tabs 424. A first support 38 of the keyswitch structure 3 includes a hole 190 and two slots 192, so that when the magnetic member 42 is assembled in the recess 186 of the first support 38, the abutting portions 422 pass through the hole 190 to rotatably abut the bottom plate 12, and the tabs 424 are inserted into the slots 192 correspondingly. The magnetic member 42 is rotatable relative to the bottom plate 12. In the embodiment, the rotation axes of the magnetic member 42 and the first support 38 relative to the bottom plate 12 are substantially the same; that is, the magnetic member 42 and the first support 38 are rotatable relative to the bottom plate 12 about the same rotation axis (indicated by a cross mark in FIG. 10). The magnetic member 42 and the magnetic portion 122 can induce an attractive force (indicated by a bold line segment with two arrows in FIG. 10) therebetween, so that the magnetic member 42 and the magnetic portion 122 tend to approach each other. In the embodiment, the magnetic member 42 is not fixedly joined to the first support 38, but under the structural constraint by the magnetic member 42 and the first support 38 on each other, the attractive force still can make the magnetic member 42 apply force to the first support 38. Under the effect of the attractive force, the directions and positions (located at two opposite sides of the rotation axis of the magnetic member 42 relative to the bottom plate 12) of forces applied by the magnetic member 42 to the first support 38 are substantially indicated by solid arrows in FIG. 10. The attractive force drives the first support 38 through the magnetic member 42 so that the first support 38 rotates counterclockwise to move the keycap 16 away from the bottom plate 12. When the first support 38 is moved by the keycap 16 to rotate clockwise (for example by pressing the keycap 16 as shown by FIG. 5 or FIG. 6), applied forces (indicated by hollow arrows in FIG. 10) of the first support 38 to the magnetic member 42 drive the magnetic member 42 to also rotate clockwise away from the magnetic portion 122.

Figure 11:
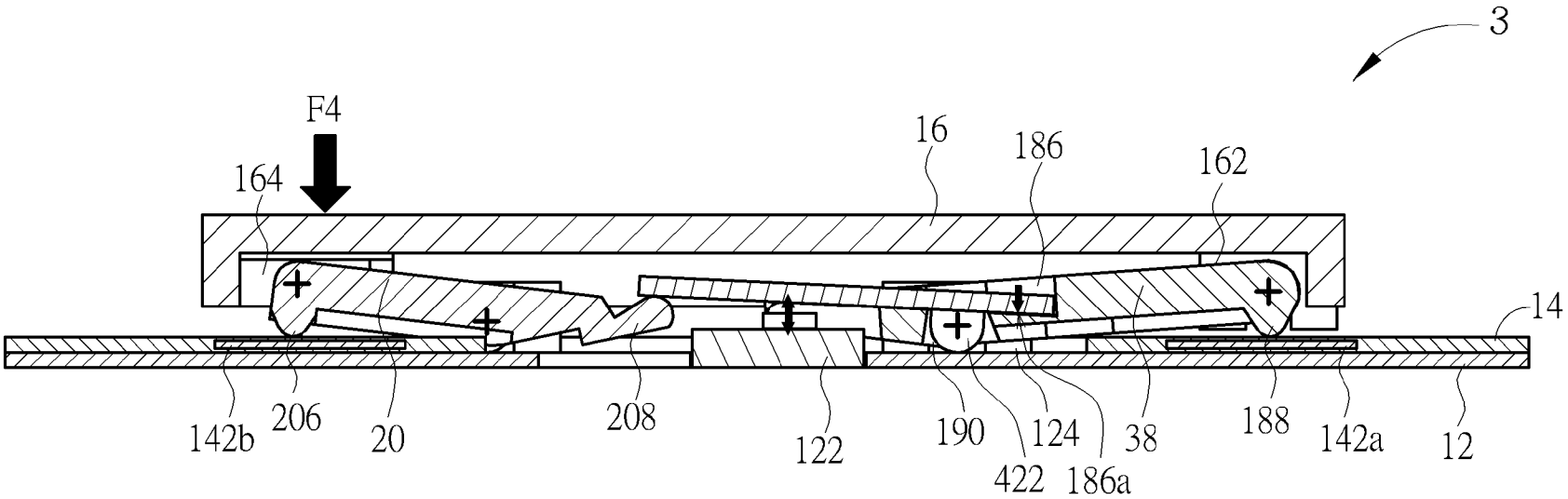
FIG. 11 is a sectional view of the keyswitch structure in FIG. 8 when a keycap thereof is pressed.

Furthermore, in the keyswitch structure 3 of the embodiment, when an external force is applied to the middle or right portion of the keycap 16, the movement of the keyswitch structure 3 is substantially equivalent to that of the keyswitch structure 1, for which please refer to FIG. 5 and FIG. 6 and the relevant descriptions. Please refer to FIG. 11, which is a sectional view of the keyswitch structure 3 when the keycap 16 is pressed. When an external force F4 is applied to the left side of the keycap 16, the keycap 16 drives the second support 20 is to rotate counterclockwise to drive the magnetic member 42 to rotate clockwise away from the magnetic portion 122; please refer to the relevant descriptions of the second support 20 in FIG. 7 for other descriptions of the second support 20 of the keyswitch structure 3. In this case, the magnetic member 42 is not fixedly joined to the first support 38, but when the second support 20 drives the magnetic member 42 to rotate clockwise, a portion of the magnetic member 42 at the right side of the abutting portion 422 will apply force to a bottom 186*a* of the recess 186, so that the first support 38 sustains a moment by the applied force and rotates clockwise and further drives the first support 38 to rotate clockwise. Therefore, under the effect of the external force F4, the movement logic of the keyswitch structure 3 is substantially equivalent to that of the keyswitch structure 1.

Figure 12:
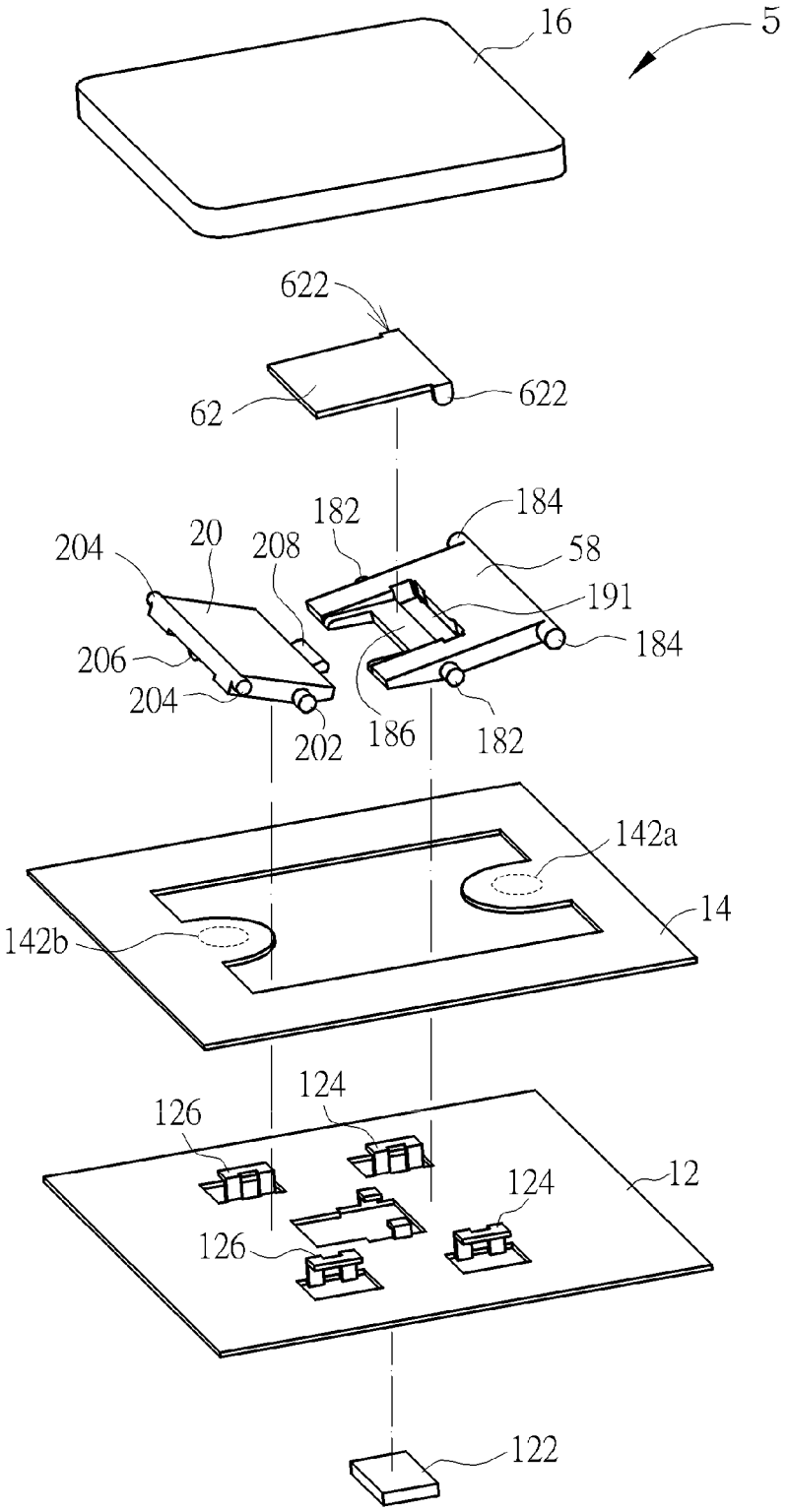
FIG. 12 is an exploded view of a keyswitch structure of another embodiment according to the invention.
Figure 13:
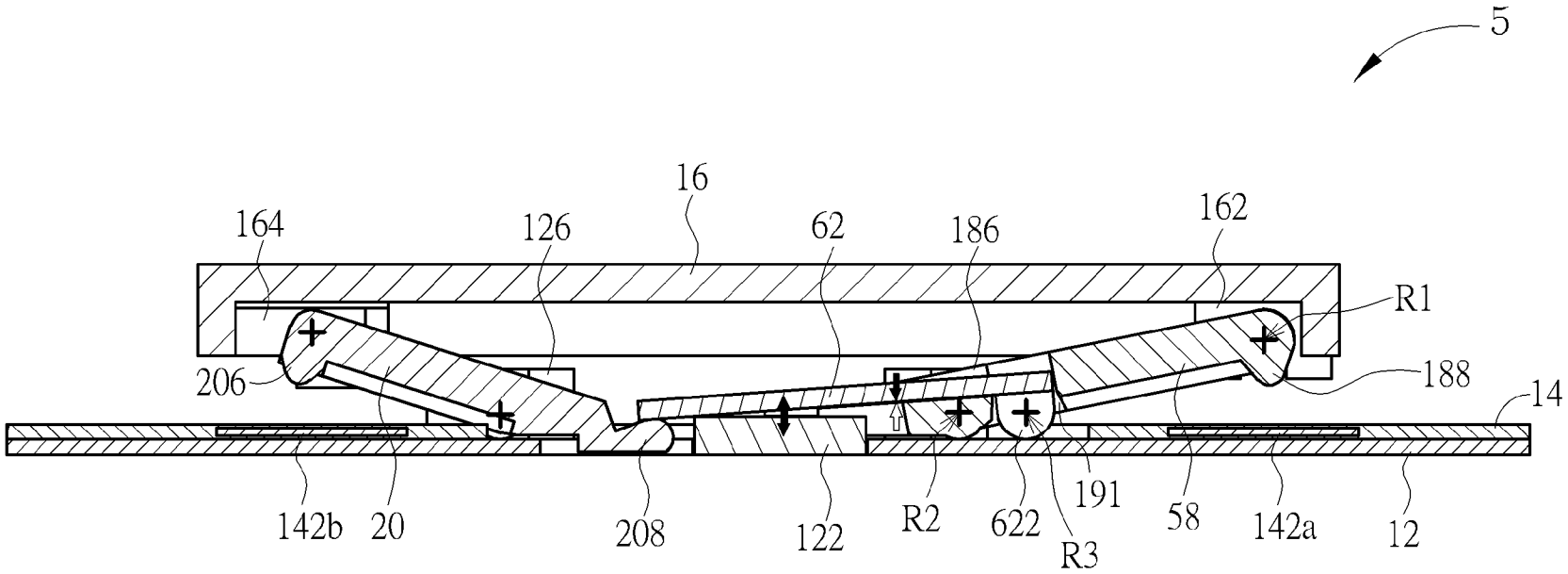
FIG. 13 is a sectional view of the keyswitch structure in FIG. 12.

In the above the embodiment, the magnetic member 42 and the first support 38 of the keyswitch structure 3 are rotatable relative to the bottom plate 12 about the same rotation axis, but the invention is not limited thereto. Please refer to FIG. 12 and FIG. 13. FIG. 12 is an exploded view of a keyswitch structure 5 of another embodiment according to the invention. FIG. 13 is a sectional view of the keyswitch structure 5; the cutting plane therefor is similar to the line X-X in FIG. 1. The keyswitch structure 5 is structurally similar to the keyswitch structure 1, so the keyswitch structure 5 uses the same notations of the keyswitch structure 1 for components with the same names. The following description will focus on the differences between the keyswitch structure 5 and the keyswitch structure 1. For the other descriptions of the keyswitch structure 5, please refer to the relevant descriptions of the keyswitch structure 1, which will not be repeated in addition.

In the embodiment, a magnetic member 62 of the keyswitch structure 5 includes two abutting portion 622. A first support 58 of the keyswitch structure 5 includes a hole 191, so that when the magnetic member 62 is assembled to the recess 186 of the first support 58, the two abutting portions 622 pass through the hole 191 and rotatably abut the bottom plate 12. The magnetic member 62 is rotatable relative to the bottom plate 12. In the embodiment, the rotation axis of the magnetic member 62 relative to the bottom plate 12 is different to that of the first support 58; that is, each of the magnetic member 62 and the first support 58 is rotatable relative to the bottom plate 12 about one rotation axis (indicated by a cross mark in FIG. 13). In the embodiment, the first support 58 includes a first portion and a second portion. The first portion (i.e. the pivot structure 184) rotatably abuts the keycap 16 substantially about a first rotation axis R1. The second portion (i.e. the pivot structure 182) rotatably abuts the bottom plate 12 substantially about a second rotation axis R2. The abutting portion 622 rotatably abuts the bottom plate 12 substantially about a third rotation axis R3. A projection of the third rotation axis R3 on the bottom plate 12 is located between projections of the first rotation axis R1 and the second rotation axis R2 on the bottom plate 12. The magnetic member 62 and the magnetic portion 122 induce an attractive force (indicated by a bold line segment with two arrows in FIG. 13) therebetween, so that the magnetic member 62 and the magnetic portion 122 tend to approach each other. In the embodiment, the magnetic member 62 is not fixedly joined to the first support 58, but under the structural constraint by the magnetic member 62 and the first support 58 on each other, the attractive force still can make the magnetic member 62 apply force to the first support 58. Under the effect of the attractive force, the direction and position (located between the second rotation axis R2 and the magnetic portion 122) of a force applied by the magnetic member 62 to the first support 58 are substantially indicated by a solid arrow in FIG. 13. The attractive force drives the first support 58 through the magnetic member 62 so that the first support 58 rotates counterclockwise to move the keycap 16 away from the bottom plate 12. When the first support 58 is moved by the keycap 16 to rotate clockwise (for example by pressing the keycap 16 as shown by FIG. 5 or FIG. 6), an applied force (indicated by a hollow arrow in FIG. 13) of the first support 58 to the magnetic member 62 drive the magnetic member 62 to also rotate clockwise away from the magnetic portion 122.

Figure 14:
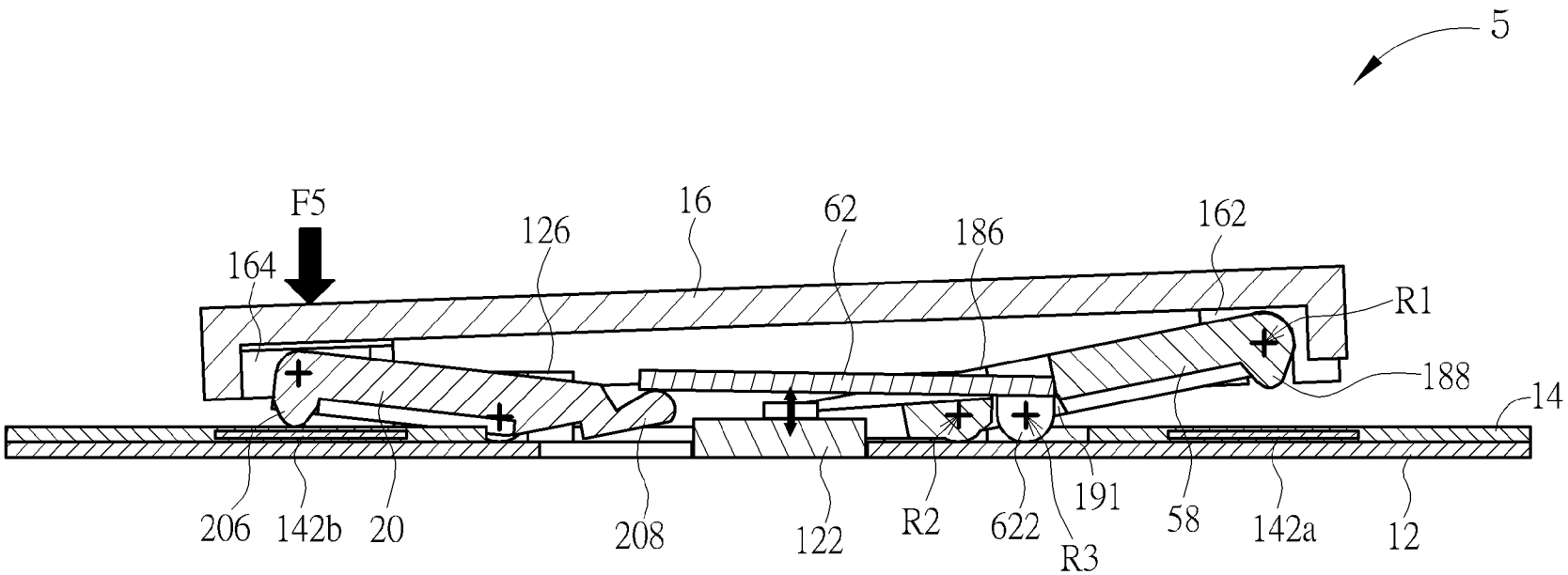
FIG. 14 is a sectional view of the keyswitch structure in FIG. 12 when a keycap thereof is pressed obliquely.

Furthermore, in the keyswitch structure 5 of the embodiment, when an external force is applied to the middle or right portion of the keycap 16, the movement of the keyswitch structure 5 is substantially equivalent to that of the keyswitch structure 1, for which please refer to FIG. 5 and FIG. 6 and the relevant descriptions. Please refer to FIG. 14, which is a sectional view of the keyswitch structure 5 when the keycap 16 is pressed obliquely. When an external force F5 is applied to the left side of the keycap 16, the keycap 16 drives the second support 20 is to rotate counterclockwise to drive the magnetic member 62 to rotate clockwise away from the magnetic portion 122; please refer to the relevant descriptions of the second support 20 in FIG. 7 for other descriptions of the second support 20 of the keyswitch structure 3. In this case, the magnetic member 62 is not fixedly joined to the first support 58, the magnetic member 62 rotate clockwise independently from the first support 58. The first support 58 does not rotate together with the magnetic member 62, so that the keycap 16 remains oblique. In practice, if the member 62 is joined to the first support 58 for example by more structural constraint, adhering and so on, the movement logic of the keyswitch structure 5 is equivalent to that of the keyswitch structure 1.

The keyswitch structures 1, 3 and 5 in the above embodiments are substantially structurally similar. One difference between them is that the connections of the magnetic members 22, 42 and 62 with the first supports 18, 38 and 58 respectively are different, so when the keycap 16 is pressed in different situations, the first supports 18, 38 and 58 and the second support 20 act a little differently, in which the keyswitch structures 1, 3 and 5 still use the attractive force induced between the magnetic members 22, 42 and 62 and the magnetic portion 122 of the bottom plate 12 to structurally constrain and drive the first supports 18, 38 and 58 and the second support 20, which at least achieves the mechanism of driving the first support 18, 38 and 58 and the second support 20 to move the keycap 16 away from the bottom plate 12. Therefore, in practice, except for cases that will cause unavoidable movement interference, the components of the keyswitch structures 1, 3 and 5 can be exchanged with each other and work normally, and the descriptions about the movement of the keyswitch structures 1, 3 and 5 are cross-referenced to each other. For example, the first support 58 of the keyswitch structure 5 also can include a structure like the slot 192 of the first support 38 of the keyswitch structure 3, and the magnetic member 62 of the keyswitch structure 5 can include a structure like the tab 424 of the magnetic member 42 of the keyswitch structure 3 correspondingly; in this case, the movement of the keyswitch structure 5 is substantially equivalent to that of the keyswitch structure 3. In addition, in the keyswitch structures 3 and 5, the magnetic members 42 and 62 and the first supports 38 and 58 are not fixedly joined, so the relative position of the rotation axes (e.g. the above rotation axes R2 and R3) of the magnetic members 42 and 62 and the first supports 38 and 58 relative to the bottom plate 12 respectively will affect the interaction force and moment of the magnetic members 42 and 62 with the first supports 38 and 58. For example, the position of the projection of the rotation axis on the bottom plate 12 will affect the interaction moment thereof, which can be understood well on a basis of the law of the lever and will not be described in more details. In addition, for avoidance of magnetic interference of the magnetic portion 122 with other components (e.g. those close to a keyboard in a notebook), it is practicable to dispose a paramagnetic metal part under the bottom plate 12.

Figure 15:
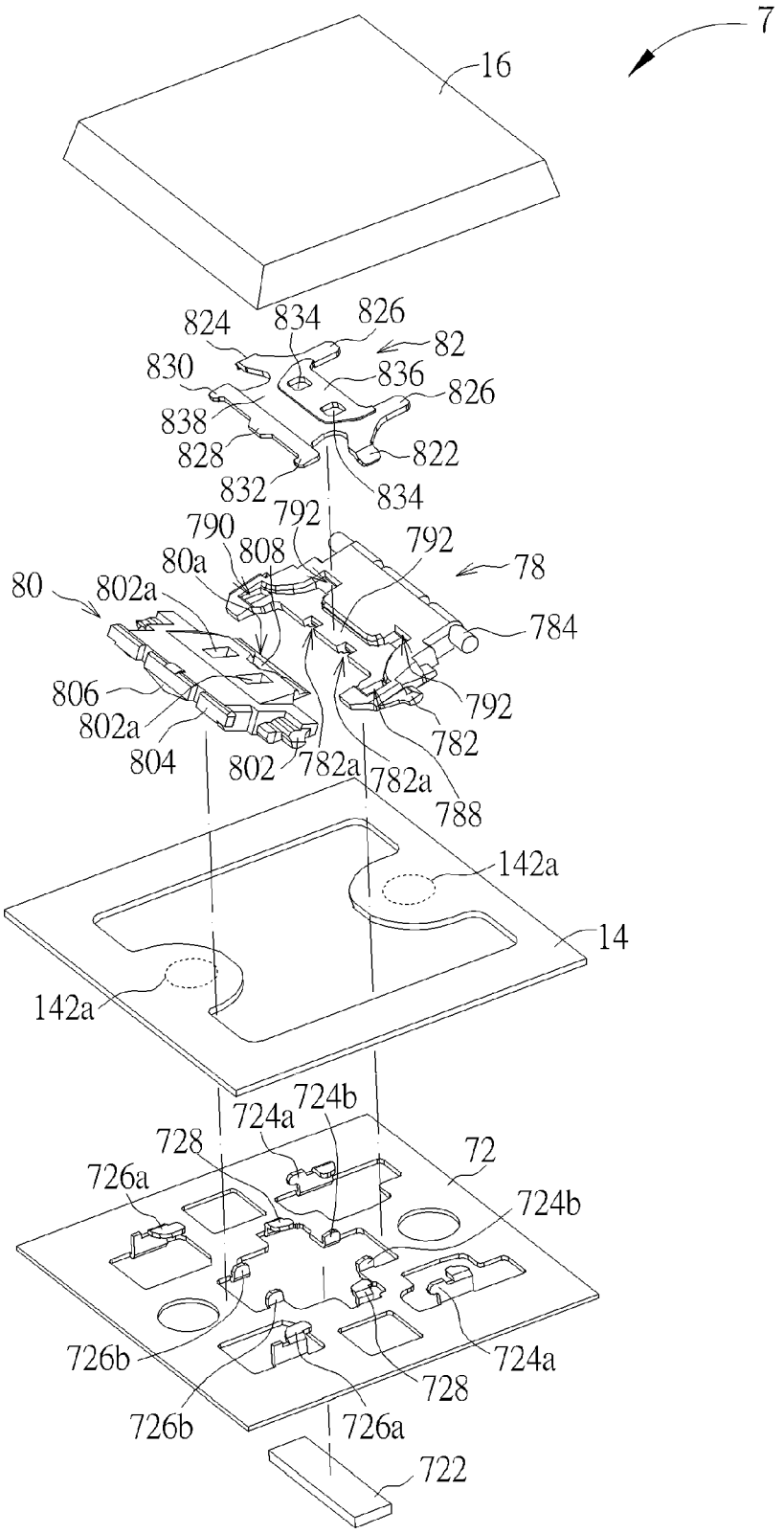
FIG. 15 is an exploded view of a keyswitch structure of another embodiment according to the invention.
Figure 16:
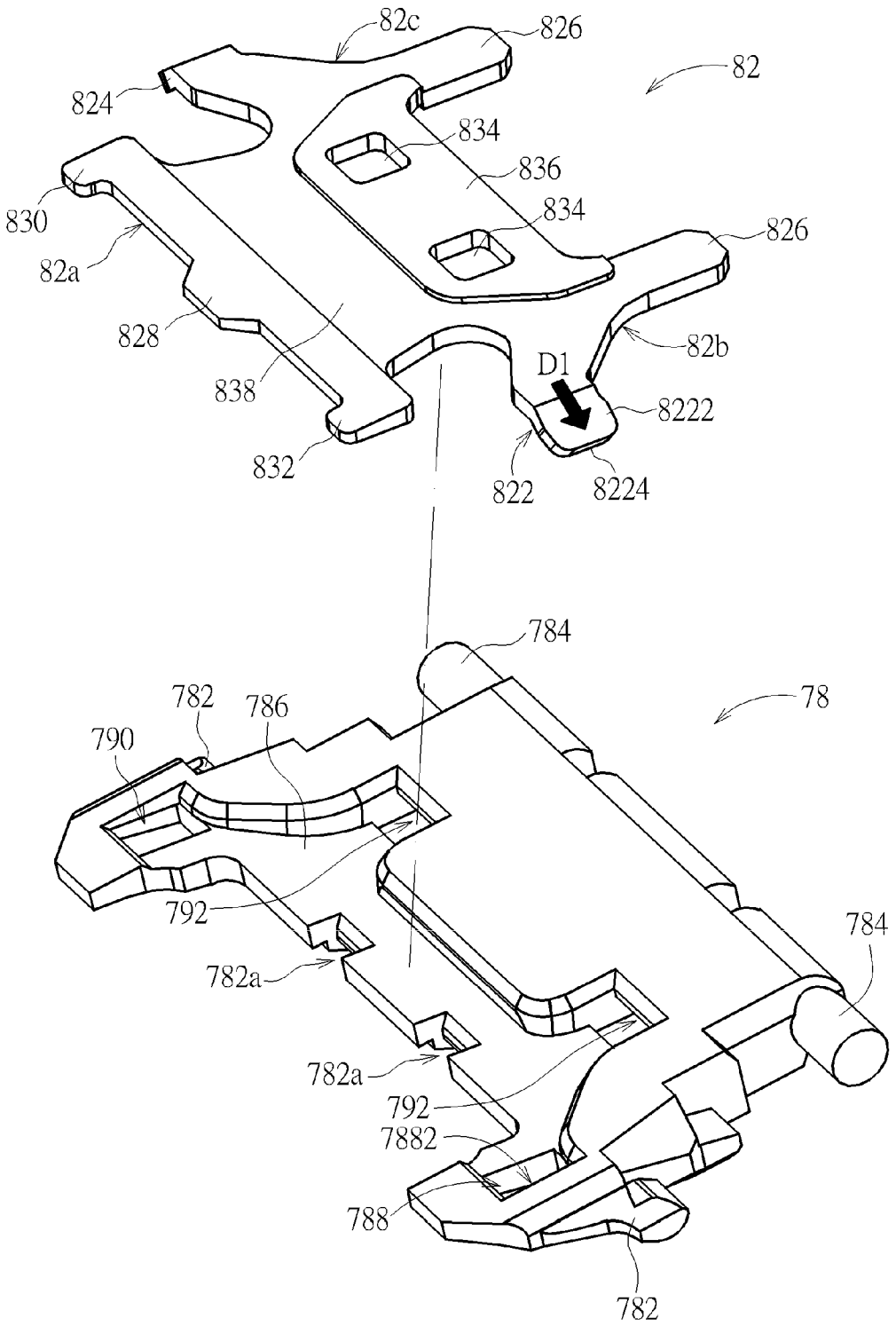
FIG. 16 is a schematic diagram illustrating assembly of a magnetic member and a first support of the keyswitch structure in FIG. 15.
Figure 17:
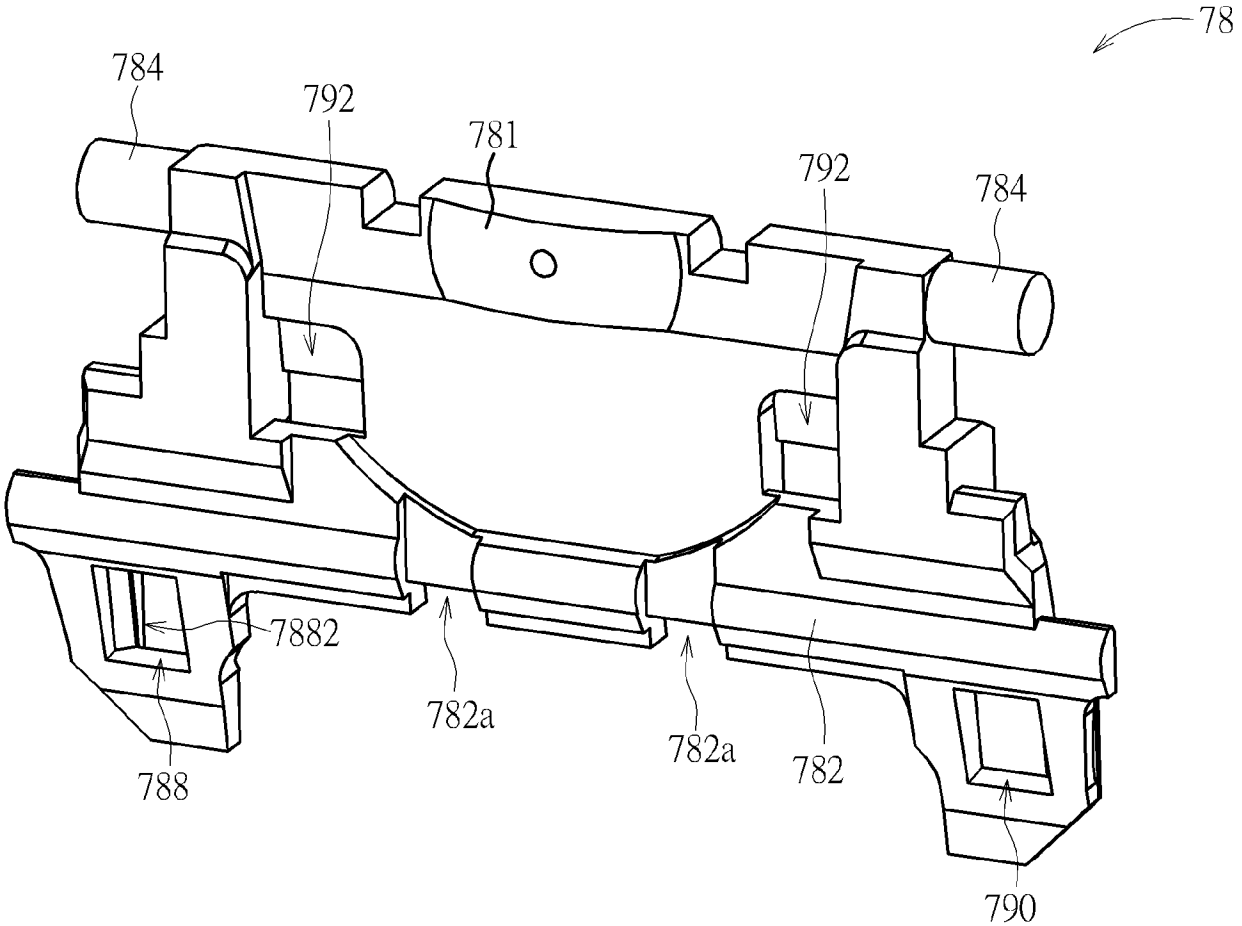
FIG. 17 is a schematic diagram illustrating the first support in FIG. 15 from another viewpoint.
Figure 18:
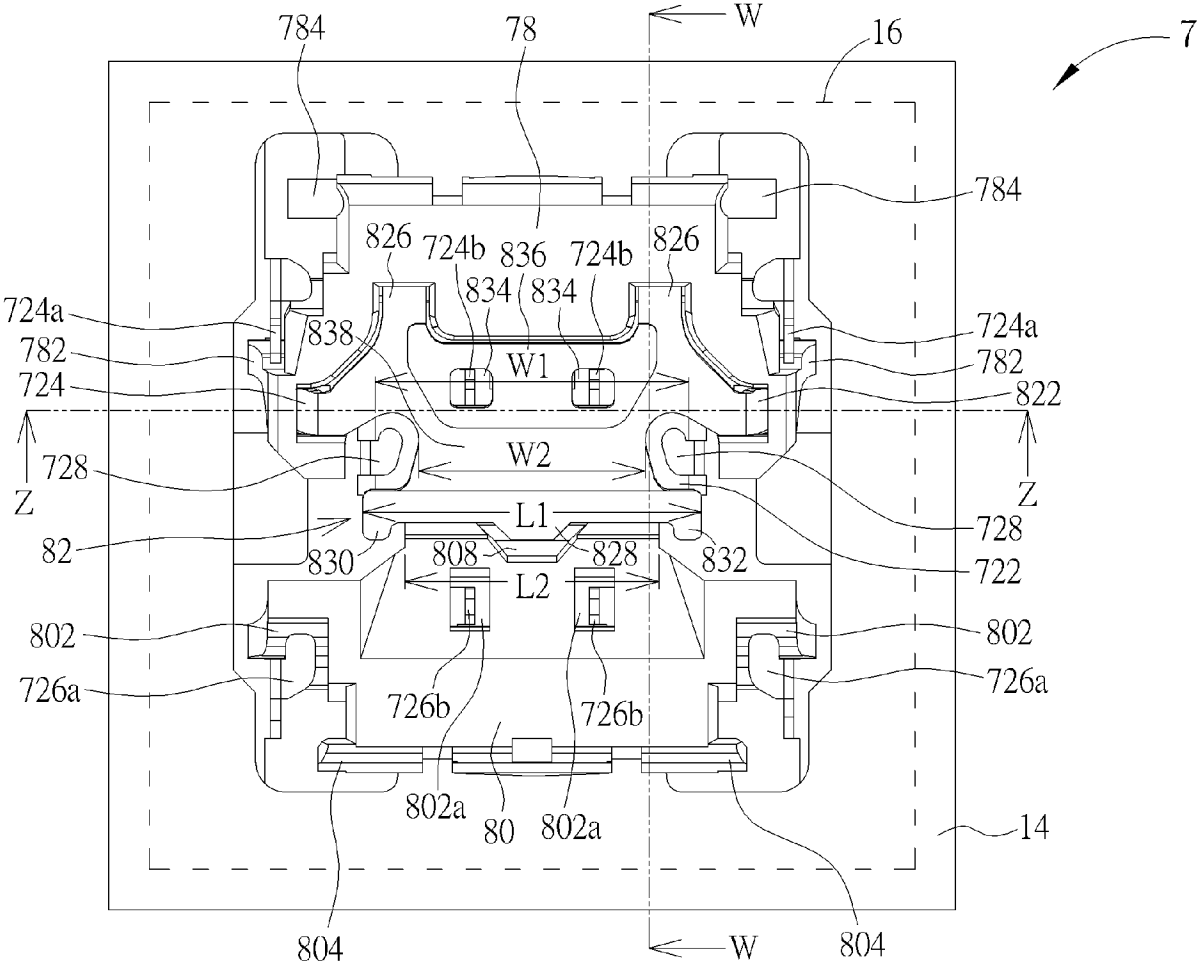
FIG. 18 is a top view of the keyswitch structure in FIG. 15.
Figure 19:
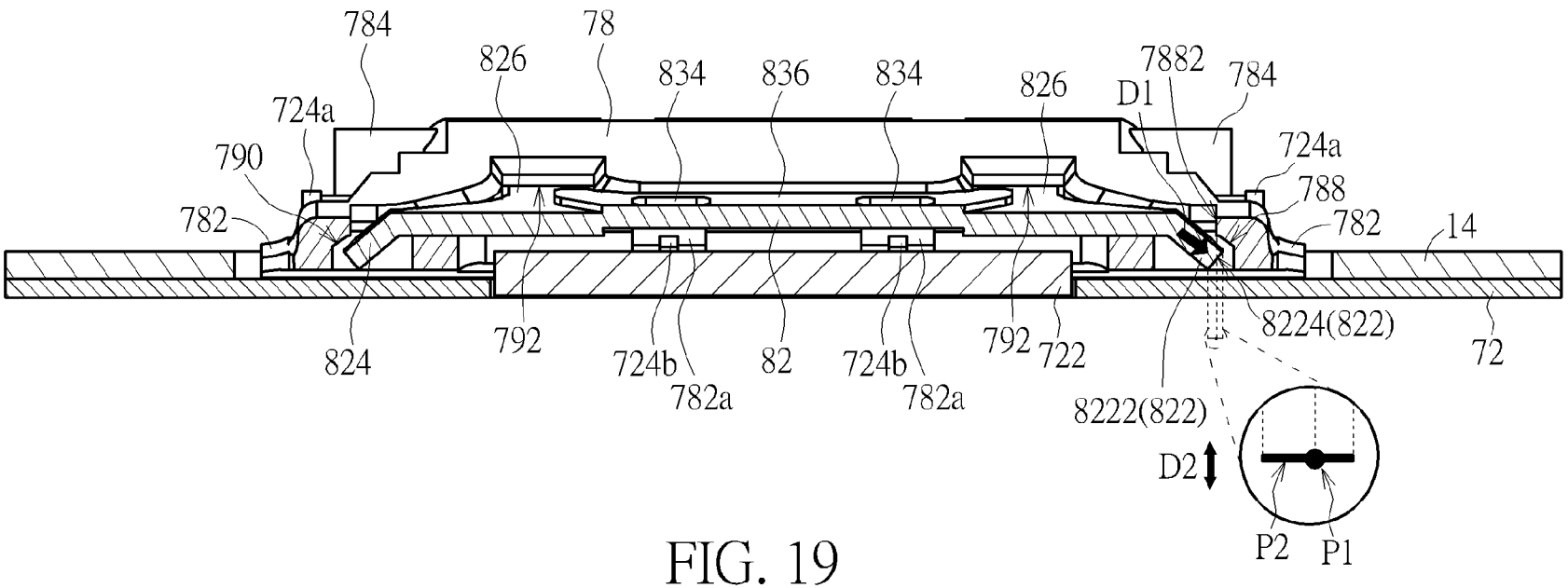
FIG. 19 is a sectional view of the keyswitch structure in FIG. 18 along the line Z-Z.
Figure 20:
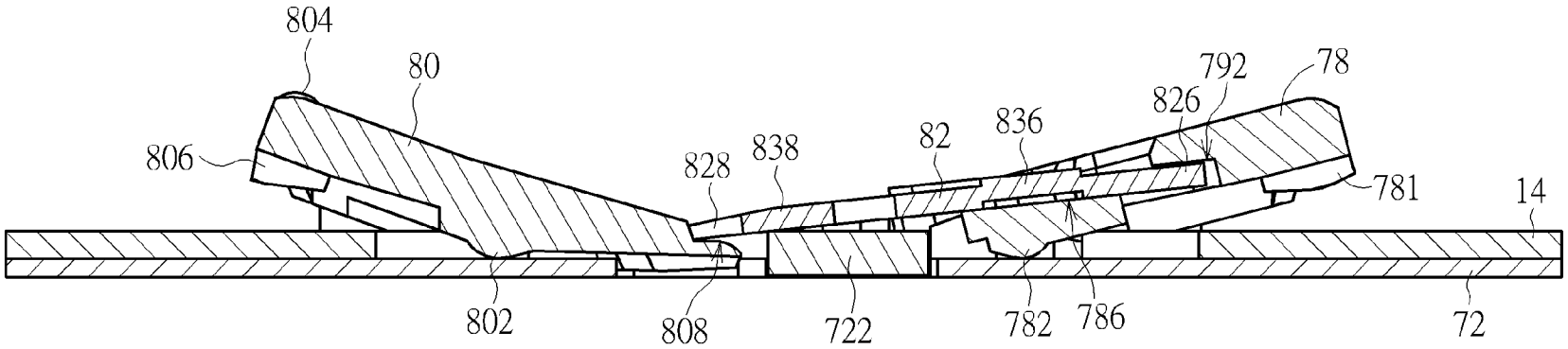
FIG. 20 is a sectional view of the keyswitch structure in FIG. 18 along the line W-W.

Please refer to FIG. 15, which is an exploded view of a keyswitch structure 7 of another embodiment according to the invention. The keyswitch structure 7 is structurally similar to the keyswitch structure 1, so the keyswitch structure 7 uses the same notations of the keyswitch structure 1 for components with the same names. The following description will focus on differences between the keyswitch structure 7 and the keyswitch structure 1. For the other descriptions of the keyswitch structure 7, please refer to the relevant descriptions of the keyswitch structure 1, which will not be repeated in addition. Compared with the keyswitch structure 1, the keyswitch structure 7 shows a structure of a magnetic member 82 joined to a first support 78. Please also refer to FIGS. 16 to 20. FIG. 16 is a schematic diagram illustrating assembly of the magnetic member 82 and the first support 78. FIG. 17 is a schematic diagram illustrating the first support 78 from another viewpoint. FIG. 18 is a top view of the keyswitch structure 7; therein, a keycap 16 is shown by its profile in dashed lines. FIG. 19 is a sectional view of the keyswitch structure 7 along the line Z-Z in FIG. 18; therein, the keycap 16 is not shown. FIG. 20 is a sectional view of the keyswitch structure 7 along the line W-W in FIG. 18; therein, the keycap 16 is not shown. Similarly, in the keyswitch structure 7, the first support 78 is connected to a bottom plate 72 and the keycap 16 by pivot structures 782 and 784 respectively. A second support 80 is connected to the bottom plate 72 and the keycap 16 by pivot structures 802 and 804 respectively. The first support 78 and the second support 80 can touch a membrane circuit board 14 for triggering switches 142*a* and 142*b* by protrusions 781 and 806 respectively. Therein, the pivot structure 782 is connected to connection portions 724*a* and 724*b* of the bottom plate 72. Two end portions of the pivot structure 782 rotatably abut the connection portions 724*a*. The pivot structure 782 has notches 782*a* at a middle portion of the pivot structure 782 and abuts the connection portions 724*b* by the notches 782*a*. The pivot structure 802 is connected to connection portions 726*a* and 726*b* of the bottom plate 72. Two end portions of the pivot structure 802 rotatably abut the connection portions 726*a*. The pivot structure 802 has holes 802*a* at a middle portion of the pivot structure 802 and abuts the connection portions 726*b* by the holes 802*a*. In practice, the disposition quantity of the connection portions 724*a*, 724*b*, 726*a* or 726*b* is not limited to two pieces and can be increased or decreased depending on the structural complexity or movement stability.

In the embodiment, the magnetic member 82 is joined to a recess 786 of the first support 78. The magnetic member 82 has a first side 82*a*, a second side 82*b*, a third side 82*c*, a first protruding portion 822, and a second protruding portion 824. The first side 82*a* and the second support 80 are opposite. The second side 82*b* and the third side 82*c* are opposite and adjacent to the first side 82*a*. The first protruding portion 822 is located at the first side 82*a*. The second protruding portion 824 is located at the third side 82*c*. The first support 78 includes a first slot 788 and a second slot 790. The first protruding portion 822 and the second protruding portion 824 are inserted into the first slot 788 and the second slot 790 respectively. In the embodiment, for a simple illustration, the first protruding portion 822 and the second protruding portion 824 are structurally the same, but the invention is not limited thereto. Therefore, for the other descriptions of the second protruding portion 824, please refer to the relevant descriptions of the first protruding portion 822, which will not be repeated in addition. The first protruding portion 822 includes a cantilever 8222 extending in an extending direction D1 slanting to the bottom plate 72. The cantilever 8222 has an oblique-end surface 8224 in the extending direction D1 that faces the bottom plate 8224. In the embodiment, the cantilever 8222 extends obliquely relative to a vertical direction D2, and the oblique-end surface 8224 is substantially perpendicular to the extending direction D1, so the oblique-end surface 8224 itself is not perpendicular to or parallel with the vertical direction D2. The first slot 788 has an edge 7882. A projection P1 (represented by a spot in FIG. 19) of the edge 7882 is located within a projection P2 (represented by a bold line segment in FIG. 19) of the oblique-end surface 8224 in the vertical direction D2 (i.e. the direction in which the keycap 16 is pressed), so that the first protruding portion 822 will not depart from the first slot 788 in the vertical direction D2. In addition, because of the above projection relation, when the magnetic member 82 is assembled to the first support 78, the edge 7882 can relatively slide on the oblique-end surface 8224, which results in a guiding effect of the oblique-end surface 8224, so that the first protruding portion 822 can be inserted into the first slot 788 smoothly (for example with a slight elastic deformation of the magnetic member 82 or the first support 822).

It is added that, as shown by FIG. 19, the first protruding portion 822 and the second protruding portion 824 can be held in the first slot 788 and the second slot 790 effectively without departing from the first support 78 by controlling clearances between the first and second protruding portions 822 and 824 and the first and second slots 788 and 790 respectively. For example, in FIG. 19, even if the magnetic member 82 is moved left and right, the first protruding portion 822 and the second protruding portion 824 still cannot depart from the first slot 788 and the second slot 790. Therefore, based on the structural characteristic, in practice, the magnetic member 82 can be provided with a single protruding portion (e.g. the first protruding portion 822), inserted into the first slot 788, and a side opposite to the single protruding portion, abutting against the inner sidewall of the recess 786, which also leads to the effect of preventing the magnetic member 82 from departing from the first support 78. For this case, the single protruding portion can be located at a side opposite to the first side 82*a* of the magnetic member 82. In addition, in the embodiment, the magnetic member 82 also has two tabs 826, inserted into two slots 792 of the first support 78 respectively, which is conducive to a firm assembly of the magnetic member 82 and the first support 78. In practice, the tab 826 can be provided in a structure like the first protruding portion 822. It is added that, in the embodiment, the first protruding portion 822 is realized by the cantilever biased to extend downward; however, the invention is not limited thereto. For example, it is practicable to use a structure like the tab 826 or a structure capable of being held by the slot 788 as the first protruding portion 822.

In addition, in the embodiment, the magnetic member 82 has a third protruding portion 828 at the first side 82*a*. The second support 80 has a middle side 80*a* and a third slot 808 at the middle side 80*a*. The middle side 80*a* is opposite to the first side 82*a*. The third protruding portion 828 moveably fits in the third slot 808, which enhances the interaction stability of the magnetic member 82 with the second support 80. Furthermore, the magnetic member 82 further has a fourth protruding portion 830 and a fifth protruding portion 832, which both are located at the first side 82*a*. The first side 82*a* of the magnetic member 82 has a middle point and two end points. The third protruding portion 828 is located at the middle point; the fourth protruding portion 830 and the fifth protruding portion 832 are located at the two end points respectively. A length L1 of the first side 82*a* of the magnetic member 82 is larger than a length L2 of the middle side 80*a* of the second support 80, so that the fourth protruding portion 830 and the fifth protruding portion 832 are free of contact with the second support 80 and extend free above the bottom plate 72, which enhances the movement stability of the magnetic member 82. In other words, in the embodiment, the fourth protruding portion 830, the third protruding portion 828, and the fifth protruding portion 832 form an E-shaped paw structure at the first side 82*a*. Therein, though under the magnetic attraction effect (by the magnetic member 82 and the magnetic portion 722), only the third protruding portion 828 abuts the second support 80; however, the invention is not limited thereto. For example, the third protruding portion 828, the fourth protruding portion 830, and the fifth protruding portion 832 all abut the second support 80 under the magnetic attraction effect, which is conducive to the interaction stability of the magnetic member 82 with the second support 80.

In addition, in the embodiment, the first support 78 is connected to the bottom plate 72 through the connection portions 724*a* and 724*b*. The magnetic member 82 has two release recesses 834 corresponding to the connection portions 724*b* and the notches 782*a*, so that when the keycap 16 is moved toward the bottom plate 72, the connection portions 724*b* relatively enter the corresponding release recesses 834, for avoidance of structural interference of the connection portions 724*b* with the magnetic member 82. In the embodiment, the release recesses 834 are realized by two through holes; however, the invention is not limited thereto. For example, it is practicable to use indentations (similar to the notch 782*a*) as the release recesses 834. Furthermore, the magnetic member 82 has a raised platform 836 formed where the release recesses 834 are disposed, which enhances the structural strength of the magnetic member 82 and compensates the reduction in the structural strength due to the formation of the release recesses 834.

Furthermore, the bottom plate 72 has two fixing structures 728 protruding upward for fixing the magnetic portion 722. The magnetic member 82 has a waist 838. Projections of the waist 838 and the magnetic portion 722 in the vertical direction D2 overlap (as shown by FIG. 18). A width W1 of the magnetic portion 722 is larger than a width W2 of the waist 838. The fixing structures 728 are located at different sides of the waist 838. In other words, the keyswitch structure 7 is assembled compactly. The waist 838 of the magnetic member 82 can avoid structurally interfering with the fixing structure 728 fixing the magnetic portion 722, with maintaining the structural strength of the magnetic member 82 as possible. Furthermore, an overlap between projections of the magnetic member 82 and the magnetic portion 722 in the vertical direction D2 will affect the magnitude of the magnetic attractive force induced between the magnetic member 82 and the magnetic portion 722, so in addition to the avoidance of structural interference with the fixing structure 728, the waist 838 in the embodiment also interact with the magnetic portion 722 to provide the magnetic attractive force as large as possible, so that the magnetic member 82 and the second support 80 can stably interact with each other.

It is added that for the other descriptions of the interaction among the first support 78, the second support 80, and the magnetic member 82 when the keyswitch structure 7 is pressed, please refer to the relevant descriptions of the keyswitch structure 1, which will not be repeated in addition. Furthermore, in the foregoing embodiments, if the magnetic member and the first support need to be fixedly joined (for example fixedly joining the magnetic member 22 and the first support 18), the joining mechanism of the magnetic member 82 and the first support 78 in the keyswitch structure 7 is applicable thereto and is not repeated in addition.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A keyswitch structure, comprising:

a bottom plate having a magnetic portion;

a keycap disposed above the bottom plate;

a first support disposed between the bottom plate and the keycap;

a second support disposed between the bottom plate and the keycap, the second support having a middle side and a third slot at the middle side, the keycap being capable of moving up and down relative to the bottom plate through the first support and the second support; and a magnetic member disposed between the bottom plate and the keycap corresponding to the magnetic portion, the magnetic member being fixed on the first support, the magnetic member having a first side and a third protruding portion at the first side, the first side being opposite to the middle side, the third protruding portion fitting in the third slot, an attractive force being induced between the magnetic member and the magnetic portion, the attractive force making the magnetic member contact and apply force to the first support and the second support so that the first support and the second support are driven to move the keycap away from the bottom plate.

2. The keyswitch structure of claim 1, wherein the first support and the second support respectively rotatably abut the bottom plate and the keycap.

3. The keyswitch structure of claim 2, wherein the magnetic member is disposed between the first support and the second support, and the first support and the second support are disposed oppositely so that when the keycap horizontally moves up and down relative to the bottom plate, the first support and the second support rotate relative to the bottom plate in opposite directions.

4. The keyswitch structure of claim 3, wherein the bottom plate comprises a connection portion, the first support is connected to the bottom plate through the connection portion, the magnetic member has a release recess, and when the keycap moves toward the bottom plate, the connection portion relatively enters the release recess.

5. The keyswitch structure of claim 3, wherein the magnetic member further has a fourth protruding portion and a fifth protruding portion at the first side, the first side has a middle point and two end points, the third protruding portion is located at the middle point, and the fourth protruding portion and the fifth protruding portion are located at the two end points respectively.

6. The keyswitch structure of claim 5, wherein a length of the first side is larger than a length of the middle side, so that the fourth protruding portion and the fifth protruding portion are free of contact with the second support and extend free above the bottom plate.

7. The keyswitch structure of claim 3, wherein the bottom plate further has a plurality of fixing structures protruding upward from the bottom plate and fixing the magnetic portion, the magnetic member has a waist, vertical projections of the waist and the magnetic portion overlap, a width of the magnetic portion is larger than a width of the waist, and the plurality of fixing structures are located at different sides of the waist.

8. The keyswitch structure of claim 3, wherein the magnetic member has a second side and a first protruding portion at the second side, and the first support comprises a first slot, in which the first protruding portion is inserted.

9. The keyswitch structure of claim 8, wherein the first side is adjacent to the second side, the first protruding portion comprises a cantilever extending in an extending direction slanting to the bottom plate, the cantilever has an oblique-end surface in the extending direction, the oblique-end surface faces the bottom plate, the first slot has an edge, and a vertical projection of the edge is located within a vertical projection of the oblique-end surface.

10. The keyswitch structure of claim 9, wherein the magnetic member has a third side and a second protruding portion at the third side, the second side and the third side are opposite, and the first support comprises a second slot, in which the second protruding portion is inserted.

11. The keyswitch structure of claim 8, wherein the first side is adjacent to the second side.

12. The keyswitch structure of claim 3, wherein the first support further comprises a recess, and the magnetic member is embedded in the recess.

13. The keyswitch structure of claim 3, wherein the second support comprises a first portion, a second portion, and a third portion, the first portion rotatably abuts the keycap, the second portion rotatably abuts the bottom plate, the third portion keeps contacting the magnetic member, and the second portion is located between the first portion and the third portion.

14. The keyswitch structure of claim 13, wherein the third portion is located between the second portion and the magnetic member.

15. The keyswitch structure of claim 1, wherein one of the magnetic portion and the magnetic member is a magnet, and the other one of the magnetic portion and the magnetic member is a paramagnetic part.

16. A keyswitch structure, comprising:

a bottom plate having a magnetic portion;

a keycap disposed above the bottom plate;

a first support disposed between the bottom plate and the keycap, the first support being a plastic part;

a second support disposed between the bottom plate and the keycap, the second support having a middle side and a third slot at the middle side, the keycap being capable of moving up and down relative to the bottom plate through the first support and the second support; and a magnetic member fixed on the first support, the magnetic member having a first side and a third protruding portion at the first side, the first side being opposite to the middle side, the third protruding portion fitting in the third slot, an attractive force being induced between the magnetic member and the magnetic portion, the attractive force making the magnetic member contact and apply force to the first support and the second support so that the first support and the second support are driven to move the keycap away from the bottom plate.

17. The keyswitch structure of claim 16, wherein the second support comprises a protruding end that keeps contacting the magnetic member.

18. The keyswitch structure of claim 17, wherein the second support comprises a pivot structure rotatably abutting the bottom plate, and the protruding end is located between the pivot structure and the magnetic member.

19. The keyswitch structure of claim 16, wherein the first support and the second support respectively rotatably abut the bottom plate.

20. The keyswitch structure of claim 16, wherein the first support and the second support respectively moveably abut the keycap, one of the first support and the second support rotatably abuts the keycap, and the other one of the first support and the second support slidably abuts the keycap.

21. The keyswitch structure of claim 16, wherein one of the magnetic portion and the magnetic member is a magnet, and the other one of the magnetic portion and the magnetic member is a paramagnetic part.

22. The keyswitch structure of claim 16, wherein the first support further comprises a recess, and the magnetic member is embedded in the recess.

23. The keyswitch structure of claim 16, wherein the bottom plate comprises a connection portion, the first support is connected to the bottom plate through the connection portion, the magnetic member has a release recess, and when the keycap moves toward the bottom plate, the connection portion relatively enters the release recess.

24. The keyswitch structure of claim 16, wherein the magnetic member further has a fourth protruding portion and a fifth protruding portion at the first side, the first side has a middle point and two end points, the third protruding portion is located at the middle point, and the fourth protruding portion and the fifth protruding portion are located at the two end points respectively.

25. The keyswitch structure of claim 24, wherein a length of the first side is larger than a length of the middle side, so that the fourth protruding portion and the fifth protruding portion are free of contact with the second support and extend free above the bottom plate.

26. The keyswitch structure of claim 16, wherein the bottom plate further has a plurality of fixing structures protruding upward from the bottom plate and fixing the magnetic portion, the magnetic member has a waist, vertical projections of the waist and the magnetic portion overlap, a width of the magnetic portion is larger than a width of the waist, and the plurality of fixing structures are located at different sides of the waist.

27. The keyswitch structure of claim 16, wherein the magnetic member has a second side and a first protruding portion at the second side, and the first support comprises a first slot, in which the first protruding portion is inserted.

28. The keyswitch structure of claim 27, wherein the first side is adjacent to the second side, the first protruding portion comprises a cantilever extending in an extending direction slanting to the bottom plate, the cantilever has an oblique-end surface in the extending direction, the oblique-end surface faces the bottom plate, the first slot has an edge, and a vertical projection of the edge is located within a vertical projection of the oblique-end surface.

29. The keyswitch structure of claim 28, wherein the magnetic member has a third side and a second protruding portion at the third side, the second side and the third side are opposite, and the first support comprises a second slot, in which the second protruding portion is inserted.

* * * * *